United States Patent [19]

Meistrick et al.

[11] Patent Number: 4,898,206

[45] Date of Patent: Feb. 6, 1990

[54] COMPRESSION RELEASE RETARDER WITH VALVE MOTION MODIFIER

[75] Inventors: Zdenek S. Meistrick, Bloomfield; Raymond N. Quenneville, Suffield, both of Conn.

[73] Assignee: The Jacobs Manufacturing Company, Bloomfield, Conn.

[21] Appl. No.: 308,837

[22] Filed: Feb. 9, 1989

Related U.S. Application Data

[60] Division of Ser. No. 120,825, Nov. 16, 1987, Pat. No. 4,838,516, which is a continuation-in-part of Ser. No. 872,494, Jun. 10, 1986, Pat. No. 4,706,624.

[51] Int. Cl.[4] ..... F16K 15/06

[52] U.S. Cl. ..... 137/512.3; 137/494

[58] Field of Search ..... 137/494, 512.3, 517

[56] References Cited

U.S. PATENT DOCUMENTS 4,191,210 3/1980 Belart ..... 137/517 X 4,552,172 11/1985 Krieger ..... 137/494 X

*Primary Examiner*—Robert G. Nilson

*Attorney, Agent, or Firm*—Donald E. Degling

[57] ABSTRACT

Apparatus is provided to increase the retarding horsepower of a compression release engine retarder driven from the exhaust valve pushtube or the fuel injector pushtube which includes a plenum communicating with the exhaust valve slave piston and the master piston driven by a remote exhaust valve pushtube or the fuel injector pushtube. A trigger check valve is located between the master piston and exhaust valve slave piston so that the initial motion of the master piston delivers energy to the plenum. At a predetermined point in the travel of the master piston, the trigger check valve is opened by the master piston to permit the delivery of the energy stored in the plenum to the slave piston. Additional pumping capability is provided by a second master piston while a control check valve communicating with the second master piston limits the intake of hydraulic fluid into the system after working pressures have been attained to that hydraulic fluid which may leak from the system.

10 Claims, 14 Drawing Sheets

FIG. 2A
PRIOR ART
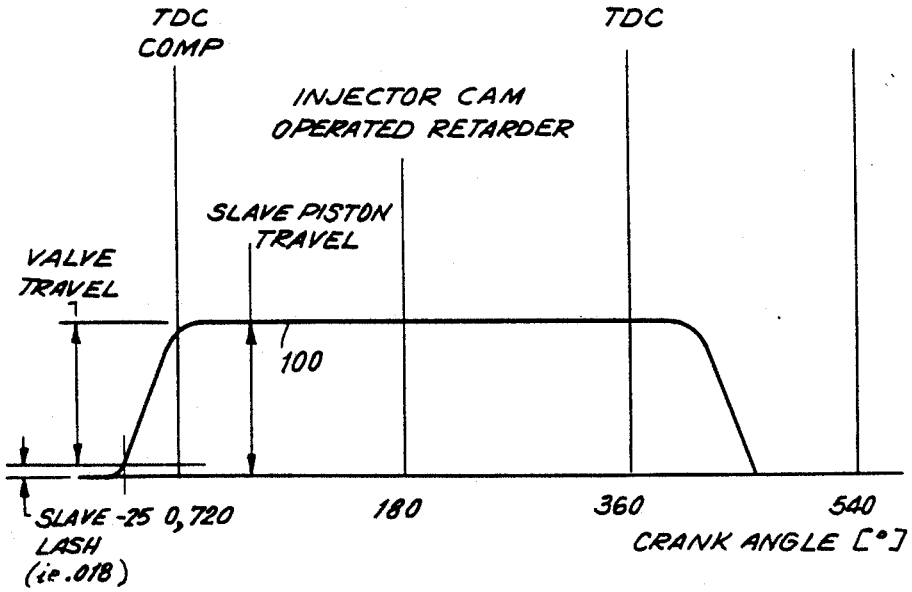
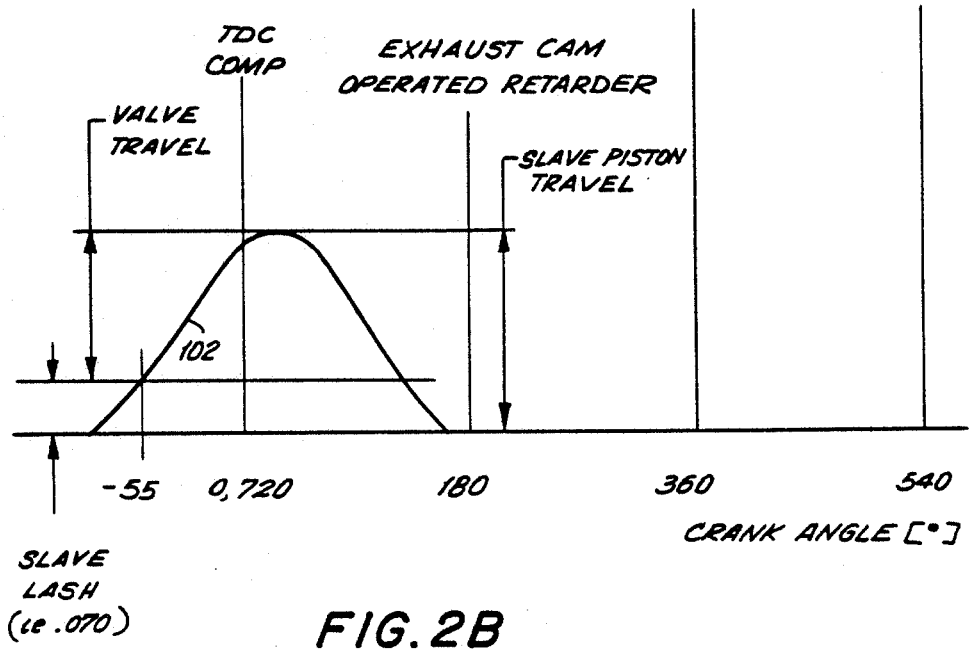
FIG. 2B
PRIOR ART

"OFF"

"ON"

~ 460°

~ 680°

~14'

~140'

COMPRESSION RELEASE RETARDER WITH VALVE MOTION MODIFIER

This application is a division of application Ser. No. 07/120,825 filed Nov. 16, 1987, now U.S. Pat. No. 4,838,516, which in turn is a continuation-in-part of application Ser. No. 06/872,494 filed June 10, 1986, now U.S. Pat. No. 4,706,624.

BACKGROUND OF THE INVENTION

1. Field of the Invention

The present invention relates to engine retarders of the compression release type. More particularly, the invention relates to an apparatus and method for modifying the motion of the exhaust valve so as to open the valve more rapidly and at a predetermined time. The invention is particularly adapted for use in engines where the retarder is driven from an exhaust or intake cam.

2. The Prior Art

Engine retarders of the compression release type are well-known in the art. In general, such retarders are designed temporarily to convert an internal combustion engine into an air compressor so as to develop a retarding horsepower which may be a substantial portion of the operating horsepower normally developed by the engine in its powering mode.

The basic design of the compression release engine retarder is disclosed in the Cummins U.S. Pat. No. 3,220,392. That design employs an hydraulic system wherein the motion of a master piston actuated by an intake, exhaust or injector pushrod or rocker arm controls the motion of a slave piston which, in turn, opens the exhaust valve near its top dead center position whereby the work done during the compression stroke of the engine piston is not recovered during the expansion or power stroke but, instead, is dissipated through the engine exhaust and cooling systems.

With compression ignition engines having a fuel injector driven from a third cam on the engine camshaft, it has been found to be desirable to derive the motion for the compression release retarder from the fuel injector pushtube for the cylinder experiencing the compression release event. The fuel injector pushtube is a desirable source of motion both because it peaks very shortly after the top dead center (TDC) position of the piston following the compression stroke and also because the effective stroke of the injector pushtube is completed in a relatively short period, e.g., 25–30 crankangle degrees. Further development of the injector-driven compression release retarder has disclosed the desirability of advancing the timing of the compression release event and this has been accomplished by a timing advance mechanism as disclosed in Custer U.S. Pat. No. 4,398,510. The Custer mechanism automatically decreases the clearance or "lash" in the valve train mechanism so that the motion of the injector pushtube-driven master piston is delivered to the exhaust valve sooner. As the "lash" approaches zero, the motion of the exhaust valve approaches the motion defined by the injector cam. Although the total exhaust valve travel can be increased or decreased by varying the ratio of the diameter of the master and slave pistons (i.e., the "hydraulic ratio"), the elapsed time during which motion occurs is determined by the motion of the master piston which, in turn, is defined by the shape of the fuel injector cam.

Many compression ignition engines employ fuel injection systems which are not driven from the engine camshaft and most spark ignition engines having fuel injection systems do not use an engine camshaft driven fuel injection system. Such engines, commonly known as two-cam engines to distinguish them from the three-cam engines referred to above, utilize a remote intake or exhaust valve pushtube or cam to operate the compression release retarder. The valve motions produced by the intake and exhaust valve cams are similar to each other but significantly different from the motion produced by the injector cam. Typically, exhaust and intake valves require more than 90 crankangle degrees to move from the closed to the fully open position. Additionally, the exhaust cam generates a motion that begins too early, reaches its peak too late and provides a total travel which is too great for optimum retarding performance. Partial compensation for these disadvantages can be effected by increasing the slave piston lash and increasing the hydraulic ratio of the master and slave pistons. Also, as disclosed in Price et al. U.S. Pat. No. 4,485,780, the rate at which the exhaust valve is opened may be increased and the time of opening correspondingly decreased by employing a second master piston driven by an appropriate intake pushtube. Although the time of opening using the invention of the Price et al. U.S. Pat. No. 4,485,780 may be reduced from about 90 to about 50 crankangle degrees, the time is still above that available with an injector cam-driven retarder. As a result, and prior to the present invention, substantially less retarding horsepower can be developed from an exhaust cam-driven retarder than from an injector cam-driven retarder when both are optimized for the same engine.

SUMMARY OF THE INVENTION

One of the principal advantages of the compression release retarder as disclosed in the Cummins U.S. Pat. No. 3,220,392 is that it may be incorporated into an engine without redesigning or replacing the camshaft or rocker arm assembly. This characteristic simplifies installations both in new engines and also, particularly, in retrofit installations on older engines. Applicants have maintained this important characteristic while improving the performance of an exhaust cam-driven compression release retarder to approach, or even exceed, the performance of an injector cam-driven retarder. While the invention is particularly directed to the exhaust (or intake) cam-driven retarder, it may also be applied to an injector cam-driven retarder. It will be understood that, in the latter case, the improvement in performance will be less marked.

In accordance with the present invention, applicants modify an exhaust cam-driven retarder by adding a plenum communicating with the slave pistons associated with the exhaust valves; a second master piston and control valve in parallel with the first master piston but driven by an intake valve cam; means to pressurize the plenum; and a trigger check valve actuated by motion of the first master piston. The control valve may be actuated by hydraulic or mechanical means and may be combined with a check valve. The trigger check valve is adjustable and may be set to open at any desired point with respect to the top dead center position of the engine piston so as to deliver rapidly a predetermined volume of high pressure oil to the slave piston, thus opening the exhaust valve rapidly at a predetermined time. The hydraulic system automatically admits fresh oil as makeup for leakage and automatically limits the maximum pressure in the plenum to that pressure required to perform the compression release function. While the invention is particularly adapted for use in two-cam engines where the master pistons are driven from the exhaust and intake cams, it may also be applied to a three-cam engine where the master pistons can be driven from any of the injector, exhaust or intake cams.

DESCRIPTION OF THE DRAWINGS

Additional advantages of the novel combination according to the present invention will become apparent from the following detailed description of the invention and the accompanying drawings in which:

FIG. 2A is a diagram showing the typical motion of an exhaust valve during the retarding mode of operation in a retarder driven by an injector cam.

FIG. 2B is a diagram showing the typical motion of an exhaust valve during the retarding mode of operation in a retarder driven by a remote exhaust or intake cam.

DETAILED DESCRIPTION OF THE INVENTION

Figures 1, 1A:
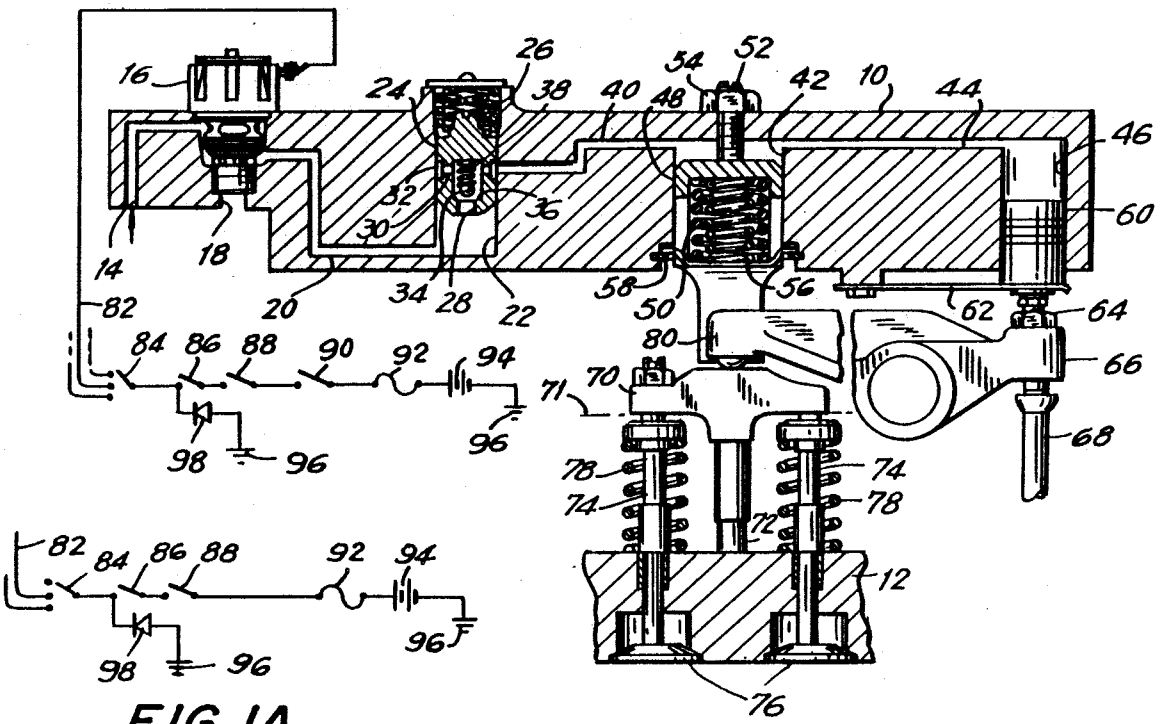
FIG. 1 PRIOR ART
FIG. 1 is a schematic diagram of a prior art compression release engine retarder of a type which may be modified to incorporate the principles and mechanisms of the present invention.
FIG. 1A is a fragmentary schemetic diagram showing an alternative electrical circuit for the apparatus shown in FIG. 1.

In order that the present invention may clearly be distinguished from the now well-known compression release engine retarder, reference will first be made to FIG. 1 which illustrates schematically a typical compression release engine retarder driven from the injector pushtube for the same cylinder or from the exhaust pushtube for another cylinder. The retarder housing 10 is attached to the engine head 12 and carries the mechanism required to perform the retarding function. Typically, for exhaust cam driven retarders, one housing 10 will contain the mechanism for three cylinders of a six-cylinder engine and a second housing 10 will be used for the remaining three cylinders. Passageway 14 communicates between a two-position three-way solenoid valve 16 and the low pressure engine lubricating oil system (not shown). Drain passageway 18 communicates between the solenoid valve 16 and the engine sump (not shown) while passageway 20 communicates with control valve chamber 22. In the energized or "on" position of the solenoid valve 16, low pressure oil flows through passageways 14 and 20 and into the control valve chamber 22. In the deenergized or "off" position of the solenoid 16, passageways 18 and 20 are in communication so as to permit drainage of oil back to the engine sump (not shown).

A two-position control valve 24 is mounted for reciprocatory motion in the control valve chamber 22 and biased toward the bottom of the chamber 22 by a compression spring 26. The control valve 24 contains an axial passageway 28 which intersects a diametral passageway 30. A circumferential groove 32 communicates with the diametral passageway 30. A ball check valve 34 is biased against a seat 36 formed in the axial passageway 28 by a compression spring 38. When the solenoid valve 16 is energized, low pressure oil lifts the control valve 24 against the bias of spring 26 and then passes the ball check valve 34. A passageway 40 communicates between the control valve chamber 22 and a slave cylinder 42 located in the housing 10, while a second passageway 44 communicates between the slave cylinder 42 and a master cylinder 46, also located in the housing 10.

A slave piston 48 is mounted for reciprocatory motion within the slave cylinder 42. The slave piston 48 is biased by a compression spring 50 toward an adjusting screw 52 threaded into the housing 10. The adjusting screw 52 is locked in its adjusted position by a lock nut 54. The lower end of the compression spring 50 seats on a retainer plate 56 which is located in the slave cylinder 42 by a snap ring 58.

A master piston 60 is mounted for reciprocatory motion in the master cylinder 46 and is lightly biased in an upwardly direction (as shown in FIG. 1) by a leaf spring 62. The master piston 60 is located so as to register with the adjusting screw mechanism 64 of rocker arm 66. The rocker arm 66 is actuated by a pushtube 68. If the retarder is driven from the fuel injector cam, rocker arm 66 will be the fuel injector rocker arm and the pushtube 68 will be the fuel injector pushtube for the cylinder associated with slave piston 48. However, if the retarder is driven, for example, from an exhaust valve cam, then the rocker arm 66 and pushtube 68 will be the exhaust valve rocker arm and pushtube for a cylinder other than the one with which the slave piston 48 is associated.

The lower end of the slave piston 48 is adapted to contact an exhaust valve crosshead 70. The crosshead 70 is mounted for reciprocatory motion on a pin 72 affixed to the engine head 12 and is adapted to contact the stems 74 of the dual exhaust valves 76 which are biased toward the closed position by valve springs 78. The line 71 indicates the rest position of the crosshead 70 when the exhaust valves 76 are closed. During the powering mode of engine operation, the exhaust valves 76 are opened by the actuation of the exhaust valve rocker arm 80 which drives the crosshead 70 downwardly (as shown in FIG. 1) against the exhaust valve stems 74.

The electrical control circuit for the retarder comprises a conduit 82 which runs from the coil of the solenoid valve 16 to a three-position switch 84. Thereafter the circuit includes, in series, a fuel pump switch 86, a clutch switch 88, a manual or dash switch 90, a fuse 92, the vehicle battery 94 and a ground 96. Preferably, the switches 86, 88 and 90 are protected by a diode 98 which is grounded. It is convenient to use one solenoid valve 16 to actuate control valves 24 associated with one retarder housing. Thus the switch 84 enables the operator to retard two, four or six cylinders of a six-cylinder engine in case of a three housing unit as contemplated by FIG. 1 or three or six cylinders of a six cylinder engine in case of a two housing unit as contemplated by FIG. 1A. As shown in FIG. 1A, no separate manual switch 90 is required since the third position of the three position switch 84 functions as a manual "OFF" switch. The fuel pump switch 86 and the clutch switch 88 are automatic switches which ensure that the fuel supply is interrupted during retarding and that the retarder is turned off whenever the clutch is disengaged. The dash switch 90 enables the operator to deactivate the system.

In operation, energizing of the solenoid 16 permits the flow of low pressure oil through the passageways 14 and 20 into the control valve chamber 22 and thence through passageways 40 and 44 into the slave cylinder 42 and master cylinder 46. Reverse flow of oil from the passageway 40 is prevented by the ball check valve 34 located in the control valve 24. Once the mechanism is filled with oil, upward motion (as shown in FIG. 1) of the master piston 60 as a result of the motion of the pushtube 68 will result in a corresponding downward motion (as shown in FIG. 1) of the slave piston 48. This, in turn, causes the exhaust valves 76 to open.

Referring to FIG. 2A which relates to a retarder mechanism driven from the fuel injector cam, it will be noted that significant motion of the fuel injector pushtube for Cylinder No. 1 begins at about 30° BTDC as the piston in Cylinder No. 1 is completing its compression stroke. Since a lash of about 0.018" is normally provided in the valve train mechanism (by means of the adjusting screw 52) the initial motion of the slave piston 48, shown by curve 100, will take up the lash so that the exhaust valve begins to open at about 25° BTDC and reaches its maximum opening just after TDC. Thus, the work done in compressing air during the compression stroke is not recovered during the ensuing expansion stroke. It may be observed that both the timing of the travel and the extent of the travel of the slave piston 48 are such that a relatively large retarding horsepower can be developed by using an injector cam-driven mechanism.

FIG. 2B shows a typical exhaust valve motion produced during engine retarding when the motion is derived from a remote exhaust pushtube and exhaust cam. It will be noted that the slave piston travel, curve 102, begins sooner, ends later, travels farther and its rate of rise is lower than when the motion is derived from the injector cam, all of which are disadvantageous for purposes of driving the retarder. Also, when utilizing a remote exhaust cam, the exhaust valve travel must be limited to avoid interference between the exhaust valve and the engine piston at TDC. This may be accomplished by increasing the valve train lash from the usual value of about 0.018" to, for example, 0.070", as shown in FIG. 2B. An advantage of increasing the valve train lash is that the exhaust valve begins to open at a later time, e.g., about 55° BTDC, and thus the cylinder pressure can build to a higher level before the compression release event occurs. However, even when the exhaust cam operation is optimized it produces significantly less retarding horsepower than an injector cam-driven retarder. The ideal condition would be, of course, to let the cylinder pressure build to its maximum and then to open the exhaust valve instantaneously. Applicants provide a mechanism which approaches this ideal.

Figure 3:
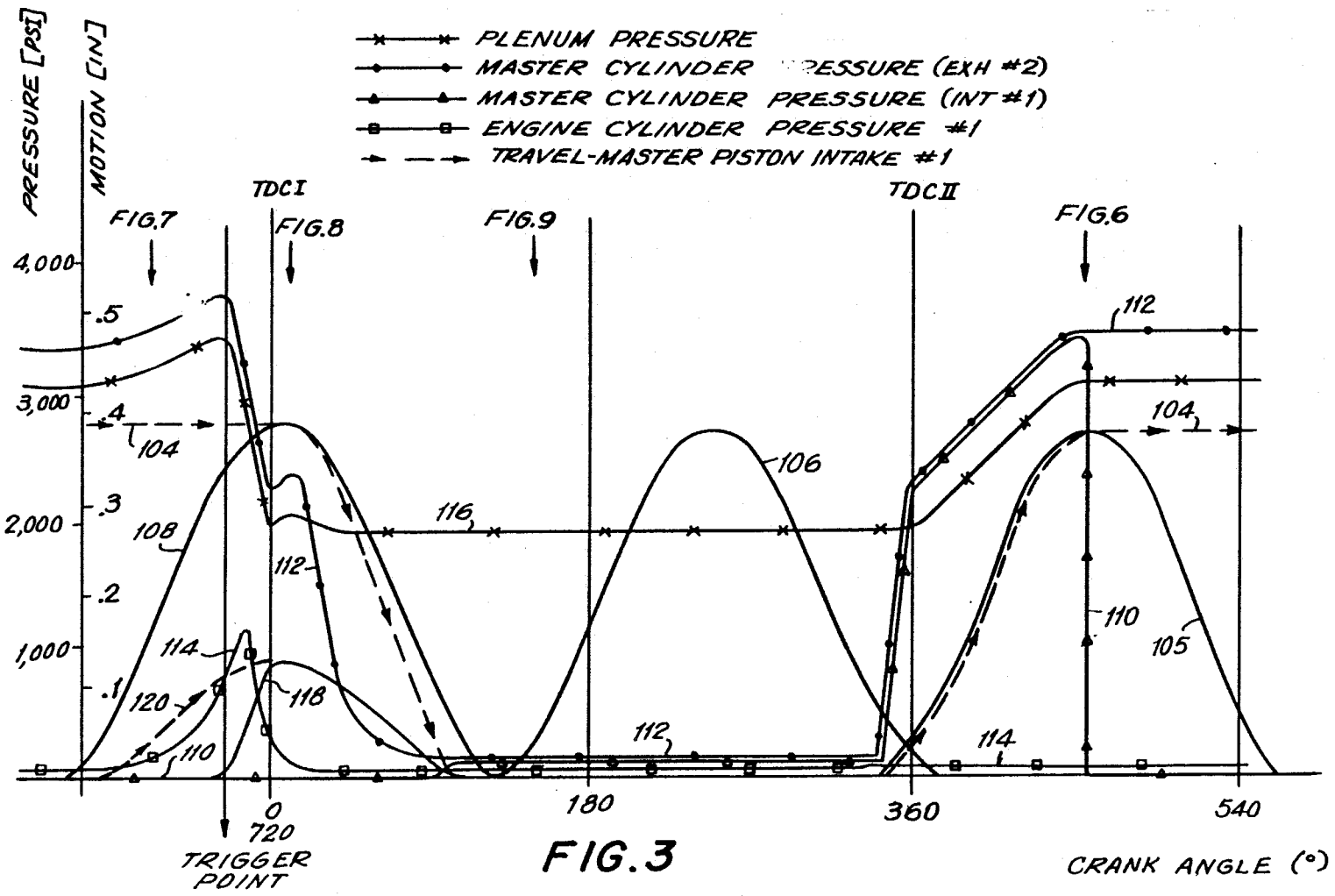
FIG. 3 is a diagram showing the motion of certain master pistons, the exhaust valve and the pressures at certain points in the mechanism of the present invention as a function of the crankangle for a complete engine cycle.

Reference is now made to FIG. 3 which illustrates, graphically, the result of applicants' method and apparatus. In FIG. 3 the ordinate is pressure or motion plotted against the crankangle position, as abscissa, where TDC I represents the top dead center position of the piston in Cylinder No. 1 following the compression stroke and TDC II represents the top dead center position of the piston in Cylinder No. 1 following the exhaust stroke. Curve 104 represents the motion of the master piston driven by the intake pushtube for Cylinder No. 1; curve 105 represents the motion of the intake pushtube for Cylinder No. 1; curve 106 represents the motion of the exhaust pushtube for Cylinder No. 1; and curve 108 represents the motion of the exhaust pushtube for Cylinder No. 2. Curve 110 shows the variation in the pressure above the master piston driven by the intake pushtube for Cylinder No. 1; curve 112 shows the variation in the pressure above the master piston driven by the exhaust pushtube for Cylinder No. 2; curve 114 shows the variation in the cylinder pressure in Cylinder No. 1; and curve 116 shows the variation in the plenum pressure. Curve 118 shows the motion of the exhaust valve during engine retarding for Cylinder No. 1 resulting from the mechanism of the present invention while curve 120 shows the motion of the exhaust valve during engine retarding for Cylinder No. 1 without the mechanism of the present invention.

Figure 4:
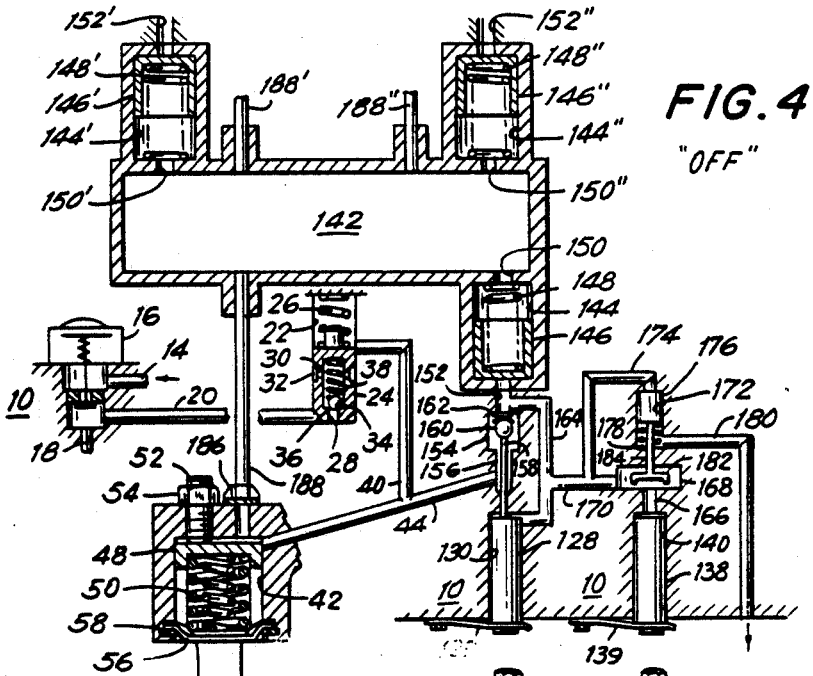
FIG. 4 is a schematic diagram of a compression release engine retarder in accordance with the present invention with the control switch in the "OFF" position.

Reference is now made to FIGS. 4–9 which show mechanism in accordance with the present invention in conjunction with the exhaust cam-driven retarder shown in FIGS. 1 and 2B. Components which are common to all Figures carry the same designation. FIG. 4 illustrates the condition of the mechanism when the compression retarding system has been shut off, e.g., the dash switch 90 (FIG. 1) or the three-position switch 84 (FIG. 1A) is in the "OFF" or open position. The mechanisms shown in FIGS. 4–9 are related to the exhaust valve for Cylinder No. 1. It will be understood that a similar mechanism is provided for each cylinder of the engine. For a six cylinder engine having the normal firing order 1-5-3-6-2-4 the relationship between the cylinders may be as shown in Table I below:

TABLE I

| Driven Slave Piston | Driving Master Pistons: Exhaust Pushtube | Intake Pushtube Alternatives: A | B | C |
|---|---|---|---|---|
| 1 | 2 | 3 | 2 | 1 |
| 2 | 3 | 1 | 3 | 2 |
| 3 | 1 | 2 | 1 | 3 |
| 4 | 6 | 5 | 6 | 4 |
| 5 | 4 | 6 | 4 | 5 |
| 6 | 5 | 4 | 5 | 6 |

As the intake master pistons are used to pump up the pressure in the plenum, any of the three alternatives shown in Table I may be employed based on preference and ease of manufacture without significantly affecting the performance. For simplicity of description, Alternative C will be referred to hereafter. The exhaust pushtube 122 for Cylinder No. 2 drives the exhaust rocker arm 124 for Cylinder No. 2 and, through the adjusting screw mechanism 126, the master piston 128 which reciprocates in the master cylinder 130 formed in the retarder housing 10. The master piston 128 is biased upwardly (as shown in FIGS. 4–9) by a light leaf spring 129. Similarly, the intake pushtube 132 for Cylinder No. 1 drives the intake rocker arm 134 for Cylinder No. 1 and, through the adjusting screw mechanism 136, the master piston 138 which reciprocates in the master cylinder 140 also formed in the retarder housing 10. The master piston 138 is biased in an upwardly direction (as shown in FIGS. 4–9) by a light leaf spring 139.

A plenum chamber 142 is formed in the retarder housing 10. The plenum chamber 142 may have any desired shape provided that its volume is large enough to absorb, temporarily, at a reasonable pressure, energy delivered from the full travel of the intake master piston and a partial travel of the exhaust master piston sufficient to open the exhaust valve against the cylinder pressure within two engine cycles. The plenum size is determined by the bulk modulus of the working fluid, in this case, engine lubricating oil. For an engine having a displacement of about 2.35 liters per cylinder, applicants have found that a plenum volume of about 10 cubic inches is sufficient to service three cylinders. Thus, a standard six cylinder engine may conveniently be provided with two retarder housings 10, each housing having a 10 cubic inch plenum 142.

For each engine cylinder it services, the plenum 142 is provided with a driving cylinder 144 within which a free piston 146 may reciprocate against the bias of a compression spring 148. The cylinder 144 communicates with the plenum 142 through passageway 150. A passageway 152 communicates between the driving cylinder 144 and a trigger check valve 154 which controls flow through passageway 156 which, in turn, connects with passageway 44. Passageway 156 is aligned with, but is isolated from, the master cylinder 130. A pin 158 closely fitted in the housing 10 contacts the end of master piston 128 and passes axially through the passageway 156. Pin 158 is of sufficient length to displace the trigger check valve ball 160 against the bias of the spring 162 and the pressure in the passageway 152 when the master piston 128 approaches the upper limit of its travel within the master cylinder 130. A bypass 164 communicates between the master cylinder 130 and passageway 152.

A passageway 166 communicates between the master cylinder 140 and a control check valve chamber 168 which, in turn, communicates with the bypass 164 through passageway 170. Control check valve cylinder 172 communicates with passageway 170 through passageway 174. Control check valve piston 176 reciprocates within the control check valve cylinder 172 and is biased toward the upward (as viewed in FIGS. 4–9) or open position by a compression spring 178. The control check valve cylinder 172 is vented through duct 180. Control check valve 182 is located in the control check valve chamber 168 and connected to the control check valve piston 176 by a rod 184 closely fitted in the housing 10.

Slave cylinder 42 communicates with the plenum 142 through a check valve 186 and a passageway 188. Check valve 186 permits flow only from the slave cylinder 42 toward the plenum 142.

It will be understood that mechanisms like those shown connected to passageways 188 and 152 for Cylinder No. 1 are connected to passageways 188' and 152' for Cylinder No. 2 and to passageways 188" and 152" for Cylinder No. 3. A duplicate system services Cylinders 4, 5 and 6.

The operation of the system will now be explained by sequential reference to FIGS. 4 through 9. As noted, FIG. 4 represents the "off" position in which the solenoid valve 16 is closed and the oil in the system (other than the plenum) is vented to the engine sump. Thus, no oil pressure exists beyond the solenoid valve 16; the control valve 24 is in the "down" (as viewed in FIG. 4) or closed position; trigger check valve 154 is held open; control check valve 182 is open, the slave piston 48 rests against the stop 52 and the master pistons 128 and 138 are biased away from the adjusting screw mechanisms 126 and 136. It will be appreciated that the retarding mechanism is out of contact with the operating parts of the engine so that the engine, in its operating mode, is entirely unaffected by the retarder mechanism.

Figure 5:
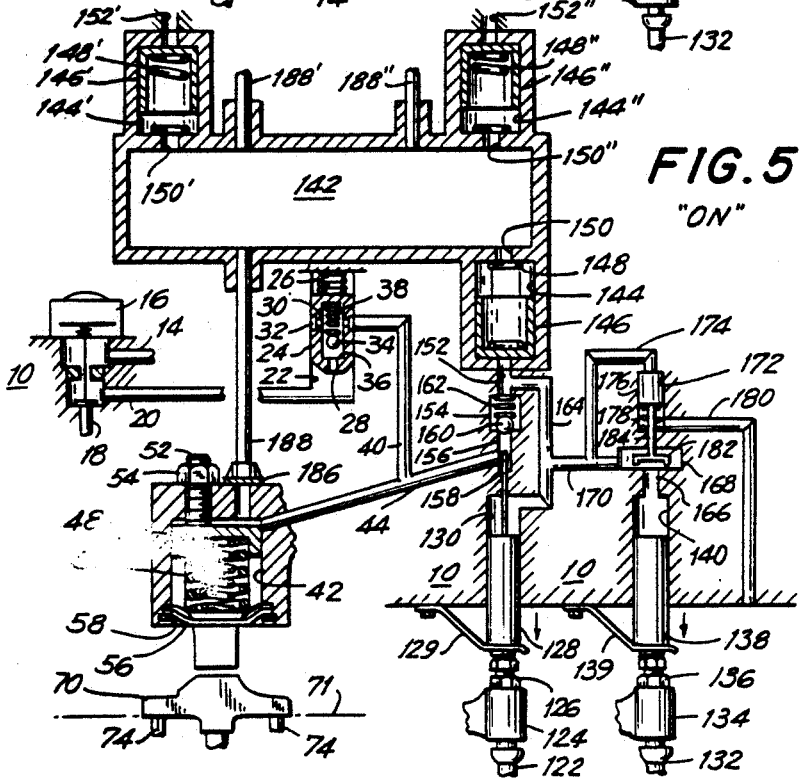
FIG. 5 is a schematic diagram of a compression release engine retarder in accordance with the present invention with the control switch in the "ON" position.

FIG. 5 shows the condition of the mechanism when the retarder is turned to the "on" position. In this mode, the solenoid valve 16 opens and low pressure oil flows from passageway 14 into passageway 20 and then into the control valve chamber 22 thereby raising the control valve 24 so that the circumferential groove 32 registers with passageway 40. Oil then flows past the ball check valve 34, through passageways 40 and 44 into the slave cylinder 42 and through the check valve 186 and passageway 188 into the plenum 142. Also, oil flows through passageways 44 and 156, past the trigger check valve ball 160 and into the master cylinders 130 and 140, causing the master pistons 128 and 138 to extend downwardly (as viewed in FIG. 5) to contact the adjusting screw mechanisms 126 and 136. It will be understood that while the low pressure oil may fill the system, the pressure is insufficient to cause any motion of the slave piston 48 or the driving piston 146.

Figure 6:
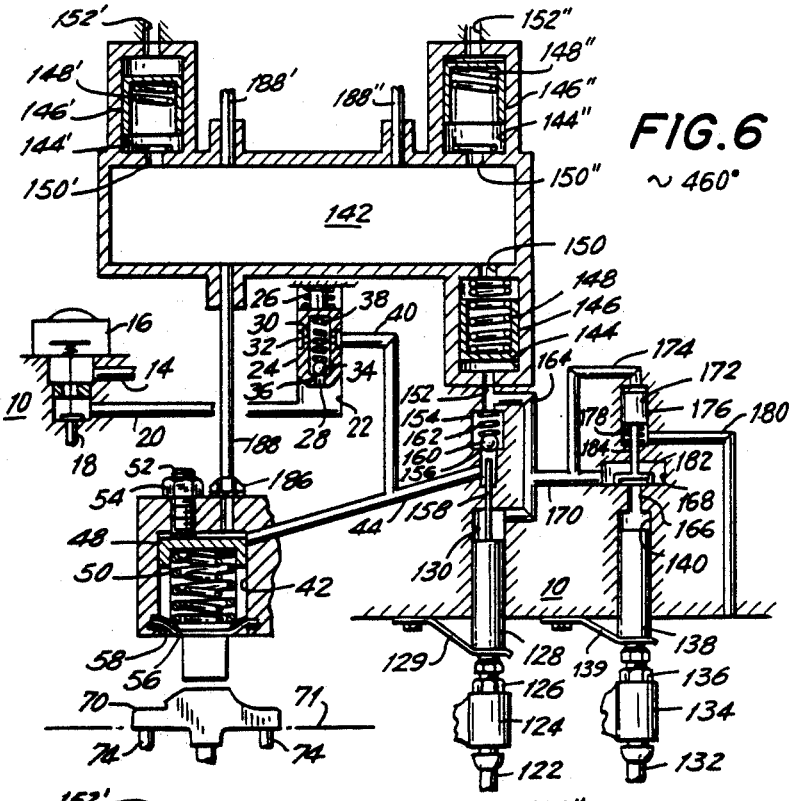
FIG. 6 is a schematic diagram of a compression release engine retarder in accordance with the present invention showing the conditions prevailing during the upward travel of the intake master piston (about 460 crankangle degrees).

Reference will now be made to FIG. 6 which shows the conditions occurring at the peak of the upward motion of the intake pushtube 132 for Cylinder No. 1 (about 460°; see FIG. 3). As the intake pushtube 132 moves upwardly (as viewed in FIG. 6) the master piston 138 is driven into the master cylinder 140 and oil is forced through passageway 166, past control check valve 182 and into the control check valve chamber 168. The control check valve 182 remains in the open position (as shown in FIG. 5) until the pressure in the control check valve chamber 168 reaches about 1,000 psi. At this point, the control check valve 182 closes (as shown in FIG. 6) and functions as a check valve. The pressure of the oil in the bypass 164 and the trigger check valve 154 assures that the trigger check valve ball 160 is seated and that the oil passes through passageway 152 and into the driving cylinder 144 so as to move the free piston 146 against the bias of spring 148 thereby rapidly increasing the pressure of the oil in the plenum 142.

Figure 7:
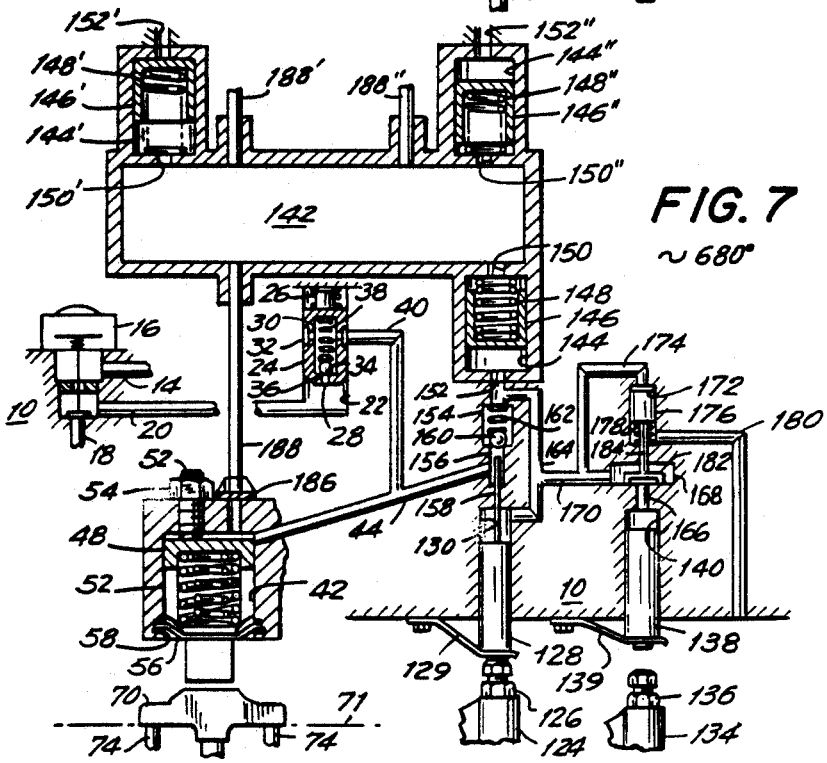
FIG. 7 is a schematic diagram of a compression release engine retarder in accordance with the present invention showing the conditions prevailing during the upward travel of the exhaust master piston (about 680 crankangle degrees).

Reference is now made to FIG. 7 which shows the events which occur at about 680° crankangle position during a portion of the upward movement (as viewed in FIG. 7) of exhaust pushtube 122 for Cylinder No. 2. As the exhaust pushtube 122 is driven upwardly, it, in turn, drives the master piston 128 upwardly (as viewed in FIG. 7) and forces oil from the master cylinder 130 into the bypass 164, the passageway 152, the trigger check valve 154 and the driving cylinder 144. The resulting upward movement (as viewed in FIG. 7) of the free piston 146 causes the pressure to rise further in the plenum 142.

At a predetermined point in the travel of master piston 128, the pin 158 contacts the trigger check valve ball 160 and forces it away from its seat. This event may occur, for example, at about 695° crankangle position. When the trigger check valve 154 is opened, a volume of high pressure oil will be delivered rapidly through passageways 156, 44, and 40 to the slave cylinder 42 (see FIG. 8). If the amount of energy is sufficiently high to drive the slave piston 48 downwardly (as viewed in FIG. 8), the exhaust valve crosshead 70 will be actuated so as to open the exhaust valves near TDC I and thereby produce a compression release event. If, on the other hand, the retarder has just been turned on and the pressure in the plenum chamber 142 is relatively low, the oil delivered from the driving cylinder 144 will pass through check valve 186 and passageway 188 and be delivered to the plenum chamber 142. The oil so delivered, together with any leakage, will be replaced through the control valve 24 beginning during return motion of the exhaust pushtube 122 for Cylinder No 2 and the corresponding downward motion of master piston 128 and ending shortly before 360° crankangle position when intake pushtube 132 for Cylinder No. 1 is again actuated. This latter condition is illustrated in FIG. 9 which shows the slave piston 42 in its rest position against the stop 52, trigger check valve ball 160 seated, and master pistons 128 and 138 in their lowermost or extended positions.

Figure 8:
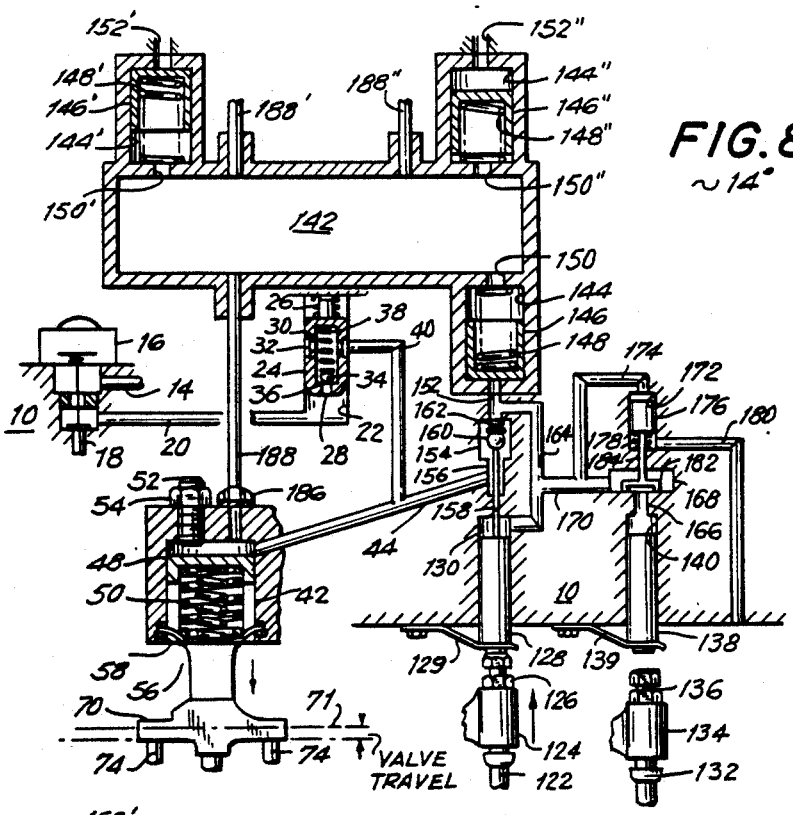
FIG. 8 is a schematic diagram of a compression release engine retarder in accordance with the present invention showing the conditions prevailing during the initial part of the compression release event (about 14 crankangle degrees).
Figure 9:
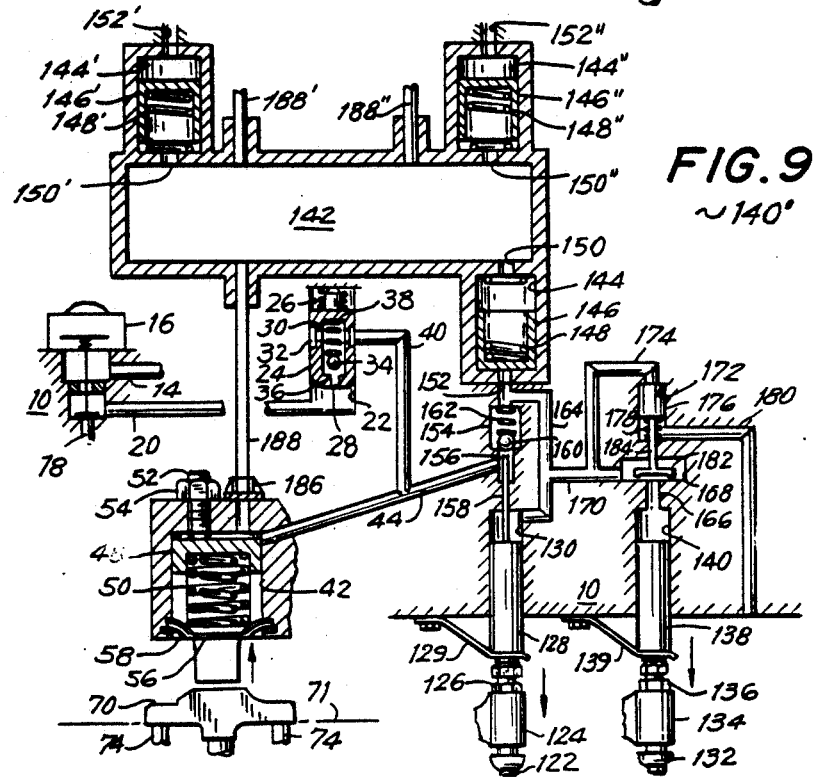
FIG. 9 is a schematic diagram of a compression release engine retarder in accordance with the present invention showing the conditions prevailing at the end of the retarding cycle (about 140 crankangle degrees).

It will be noted in FIGS. 7 and 8 that the control check valve 182 remains closed and the master piston 138 remains in the upward position even though the pushtube 132 has retracted. The areas of control check valve 182 and piston 176 are coordinated with the spring rate of compression spring 178 so that whenever the pressure in passageways 170 and 174 rises above about 1,000 psi the control check valve 182 will close and will remain closed so as to function as a check valve until the pressure drops below about 400 psi. This design limits the oil introduced into the system to the amount required to attain a pressure sufficient to drive the slave piston 48 downwardly and thereby open the exhaust valve, plus leakage. Oil which may leak past the slave piston 48 or the master pistons 128 and 138 is returned to the engine sump along with the oil used to lubricate the rocker arm assembly. Oil which may leak past the piston 176 and rod 184 is vented to the rocker arm region through vent duct 180. Oil released from the system over the control valve 24 when the system is turned off returns to the sump through duct means (not shown).

It will be understood that the pressure rise in the plenum 142 during each engine cycle depends upon the displacement of the master pistons 128 and 138 and the volume of the plenum 142. More particularly, the increase in plenum pressure may be determined by the formula:

$$\Delta p = \frac{\Delta V}{V} \beta$$

Where $\Delta p$ = Plenum pressure rise (psi)

$\Delta V$ = Volume of oil displaced by master pistons (in.$^3$)

$V$ = System volume (plenum volume plus volume of related passages) (in.$^3$)

$\beta$ = Bulk Modulus of oil (approx. 200,000 psi for engine oil)

Also, the pressure drop during a compression release event depends on the volume of the plenum. A large plenum will require a number of engine cycles in order to attain its operating pressure level, but will maintain a more nearly constant pressure level during operation. As noted above, applicants have found a 10 cubic inch plenum adequate to service three cylinders of a 12 to 14 liter six cylinder engine. In this arrangement, operating plenum pressure can be attained within two engine cycles. It will be understood that applicants have utilized the compliance of the oil contained in the system, and, particularly in the plenum, to absorb and release the energy delivered by the master pistons.

Referring to FIG. 3 it will be noted that the compression release exhaust valve opening (curve 118) is triggered just before TDC I by the opening of the trigger check valve 154 and is evidenced by a drop in plenum pressure (curve 116) or pressure above the exhaust master piston 128 (curve 112). Since the motion of the master piston 128 is precisely determined by the exhaust cam for Cylinder No. 2, the timing of the opening of the trigger check valve 154 is determined by the length of the pin 158. Thus, the timing of the compression release event is fully controllable by the designer. Moreover, the rate at which the exhaust valve opens depends on the amount of energy delivered from the driving cylinder 144 and is independent of the shape of the injector, exhaust or intake cam which may thus be designed to best accommodate its primary function. However, because the exhaust valve may now be opened very rapidly and at any desired time, the retarding horsepower can be maximized for a given set of engine conditions.

Tests on a six cylinder 14 liter engine equipped with a conventional exhaust cam-driven retarder produced 275 horsepower at an engine speed of 2100 RPM. When this retarder was modified to test the concepts of the present invention, the retarding horsepower was increased by over 100 horsepower at the same engine speed.

Figure 10:
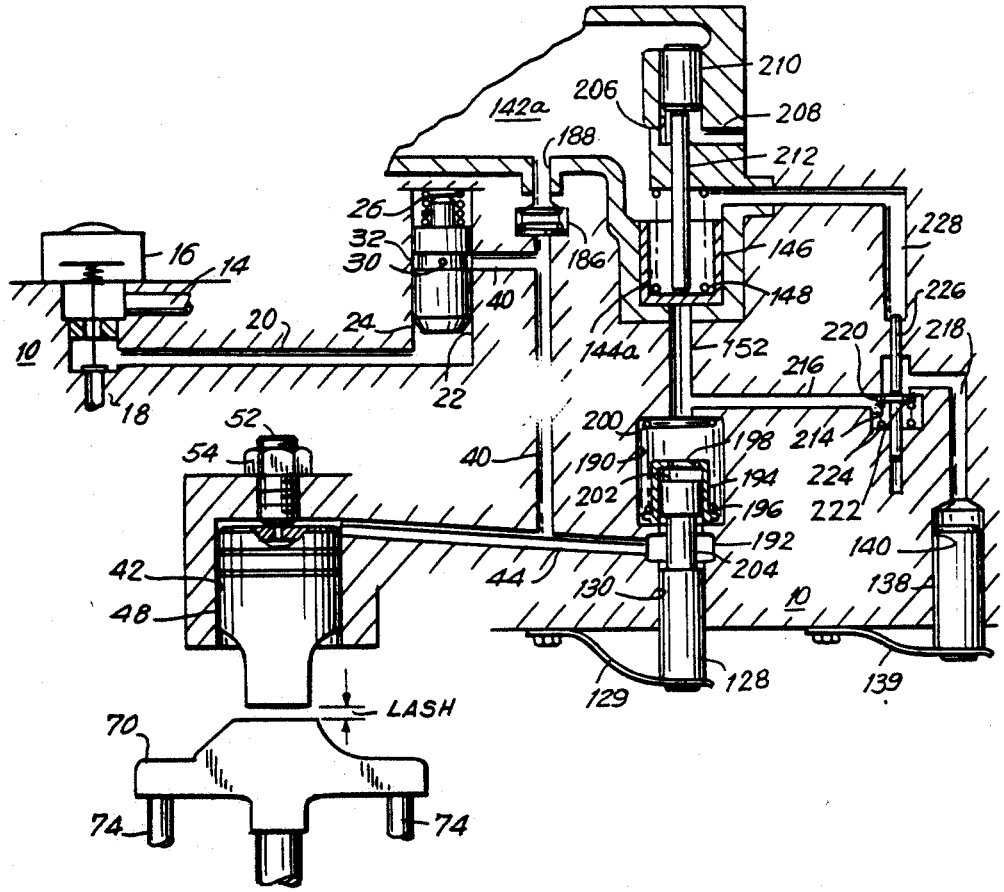
FIG. 10 is a fragmentary diagram of a modified form of an engine retarder in accordance with the present invention incorporating a modified trigger check valve and a modified control check valve.

Reference is now made to FIG. 10 which illustrates, in schematic form, a modification of the trigger and control check valve mechanisms. To the extent that the parts in FIG. 10 are also shown in FIGS. 4–9, the same designators will be used and the earlier description will not be repeated. Modified parts will be designated by a subscript (a).

The trigger check valve mechanism comprises a cavity 190 formed in the housing and communicating at one end with the master cylinder 130 and at the other end with passageway 152. The master cylinder 130 is formed with an annular cavity 192 which communicates with passageway 44 and permits a flow past the master piston 128 when that piston is in its uppermost position as viewed in FIG. 10. A tubular valve element 194 having a rim 196 at its open end and a hole 198 at the opposite end is biased toward the bottom of the cavity 190 by a compression spring 200. The compression spring 200 is positioned between the top of the cavity 190 and the rim 196 of the tubular valve element 194. A piston 202 is adjustably mounted on one end of a connecting rod 204 for reciprocating movement within the tubular valve element 194. The opposite end of the connecting rod 204 is fixed to the master piston 128. It will be appreciated that the piston 202 and tubular valve element 194 function as a valve which opens whenever the master piston 128 moves far enough in an upward direction so that the piston 202 raises the tubular valve element 194 off its seat against the bias of compression spring 200 and the pressure within the cavity 190. Until the tubular valve element 194 is lifted from its seat, motion of the master piston 128 and piston 202 pump hydraulic fluid from the cavity 190 through passageway 152 and into driving cylinder 144*a*.

A firing cylinder 206 is formed within the plenum 142*a* coaxially with the driving cylinder 144*a*. The firing cylinder 206 is vented through passageway 208. A firing piston 210 is mounted for reciprocatory motion in the firing cylinder 206 and is spaced from the free piston 146 by a drive pin 212 which is closely fitted in the wall of the plenum 142*a*.

A check valve chamber 214 is formed in the housing 10 and communicates with passageway 152 through passageway 216 and with the intake master cylinder 140 through passageway 218. Check valve 220 is biased toward a seat 222 formed in the check valve chamber 214 by a compression spring 224. The check valve 220 is mounted on a guide pin 226 which is closely fitted in the housing 10. One end of the guide pin 226 extends into passageway 228 which communicates with the plenum 142*a*. It will be noted that the pressure in the plenum 142*a* is applied to each side of the check valve 220, but the pressure is applied to different areas. As will be apparent, the pressure exerted through passageway 216 is applied to the area of the check valve 220 while the pressure exerted through passageway 228 is applied to the much smaller area of the guide pin 226. It will also be observed that when the free piston 146 is seated against the end of the driving cylinder 144*a* communicating with passageway 152, the pressure in passageways 152 and 216 may be substantially less than the pressure in the plenum 142*a*.

The operation of the mechanism shown in FIG. 10 is substantially like that of the mechanism shown in FIGS. 4–9. When the retarder is in the "OFF" position, the check valve 220 will be held open so long as the pressure in the plenum 142*a* exceeds the pressure in passageway 152. Additionally, since the control valve 24 is in the "down" position (as shown in FIG. 4) the pressure in passageways 40, 44, 152 and 216 will be released and the master piston 128 will return to its uppermost position thereby holding tubular valve element 194 in the open position.

When the retarder is turned on by energizing the solenoid valve 16, hydraulic fluid will be pumped at low pressure through passageways 40 and 44 and into master cylinder 130, cavity 190, passageways 152 and 216, check valve chamber 214, passageway 218 and master cylinder 140. When master cylinder 130 is filled, the tubular valve element 194 will seat.

At about 360 crankangle degrees, the intake valve pushtube for Cylinder No. 1 begins to drive master piston 138 upwardly (as shown in FIG. 10) so as to apply pressure to passageways 216 and 152, cavity 190 and free piston 146. When the pressure due to the motion of master piston 138 exceeds the pressure in the plenum 142*a*, the free piston 146 will be displaced upwardly. When master piston 138 stops its upward movement at about 450°, the check valve 220 will remain closed, thereby maintaining the pressure in cavity 190.

At about 630 crankangle degrees, the exhaust pushtube for Cylinder No. 2 begins to drive master piston 128 upwards (as shown in FIG. 10) thereby further pressurizing the cavity 190 and driving free piston 146 further in an upward direction. It will be understood that upward motion of the free piston 146 results in an increase in the pressure within the plenum 142*a*.

At a predetermined point, which may be, for example, about 695 crankangle degrees, piston 202 driven by the master piston 128 lifts the tubular valve element 194 from its seat thereby permitting the pressure energy stored in the plenum 142*a* and the high pressure fluid under the free piston 146 to be delivered rapidly through passageway 44 to the slave cylinder 42. If the fluid pressure is high enough to overcome the engine cylinder pressure and the bias of the valve springs 74, the slave piston 48 will drive the crosshead 70 downwardly against the valve stems 74 so as to open the exhaust valves 76. If the fluid pressure is insufficient to open the engine exhaust valve, the hydraulic fluid will be pumped through check valve 186 into the plenum 142*a*. It will be appreciated that a small addition of hydraulic fluid to the plenum 142*a* will result in a substantial pressure rise in the plenum 142*a* during the ensuing cycle.

Consideration of the mechanism shown in FIG. 10 will reveal that although the lifting of the tubular valve element 194 signals the beginning of the valve opening event, the rate at which the slave piston moves downwardly is controlled by the rate at which the free piston 146 moves downwardly. The rate of motion of free piston 146 is proportional to the net downward force acting upon the piston 146. Since the fluid pressure on each side of the free piston 146 and the areas against which it acts are substantially equal, the net force available to drive the free piston 146 downwardly is substantially equal to the spring rate of compression spring 148. Although it is desirable to maximize the rate of spring 148, there are physical constraints in the apparatus which limit the spring rates which may be employed. In order to increase the net downward force available to accelerate the free piston 146, applicants provide firing piston 210 and drive pin 212. It will be seen that the additional force acting downwardly on the free piston 146 is proportional to the difference between the cross-sectional areas of the firing piston 210 and the drive pin 212.

Figure 11A:
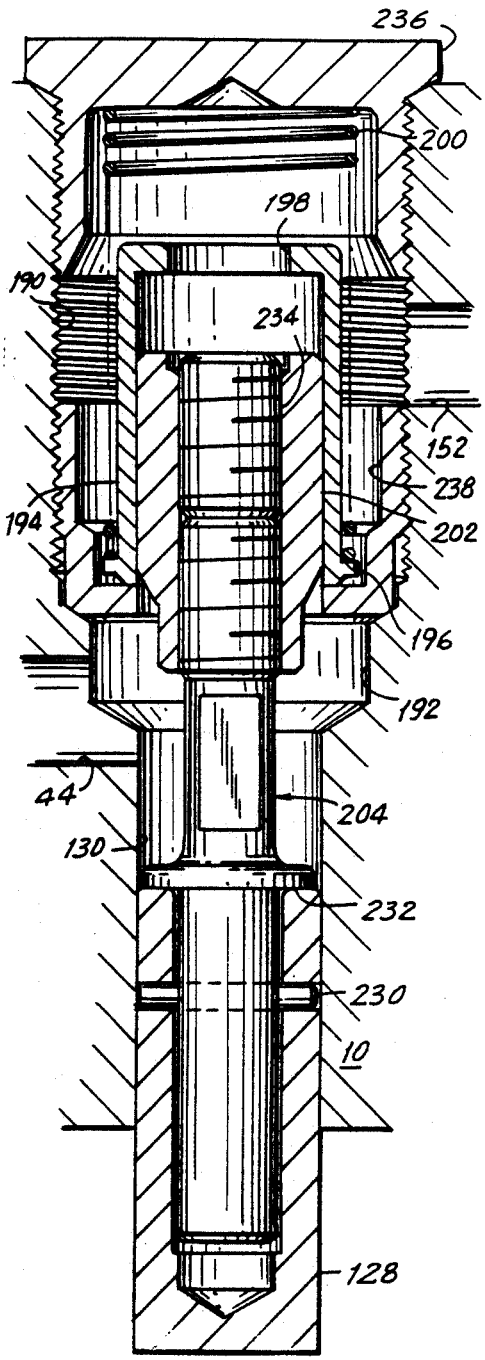
FIG. 11A is a cross-sectional view of the modified trigger check valve shown in FIG. 10 in its unactuated position.
Figure 11B:
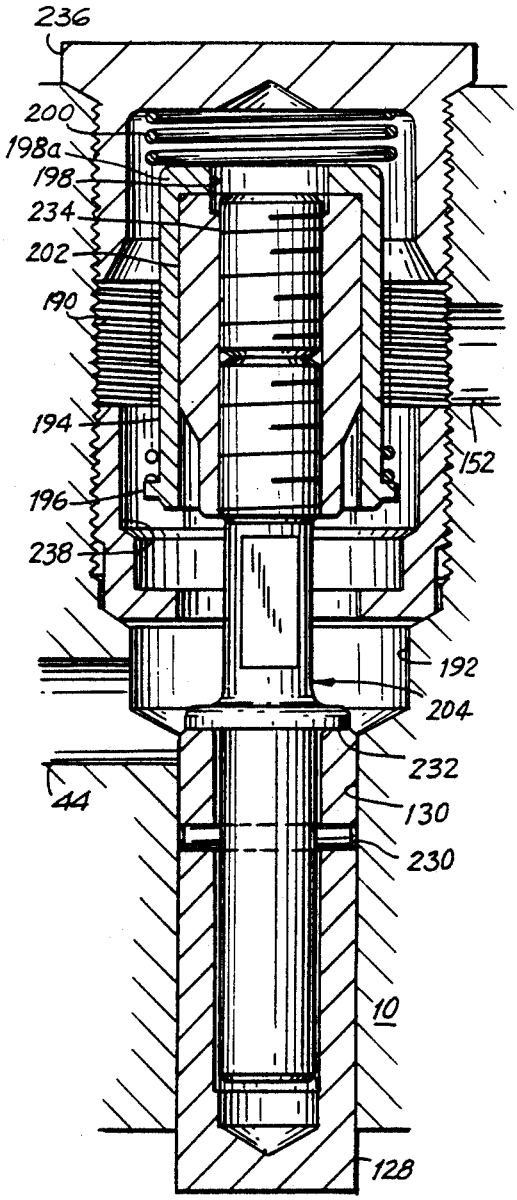
FIG. 11B is a cross-sectional view of the trigger check valve of FIG. 11A in its actuated position.

FIGS. 11A and 11B show additional details of the construction of the trigger check valve shown schematically in FIG. 10; FIG. 11A shows the mechanism at the beginning of the stroke of the master piston 128 while FIG. 11B shows the mechanism at the end of the stroke of the master piston 128. Connecting rod 204 may be affixed to the master piston 128 by a pin 230 and is provided with a shoulder 232 adjacent the upper end of the master piston 128. The upper end of the connecting rod 204 is threaded to receive the adjustable piston 202. The piston 202 is locked into its adjusted position on the connecting rod 204 by a set screw 234. The piston 202 reciprocates within a tubular valve element 194 which is biased in a downwardly direction (as shown in FIGS. 11A and 11B) by a compression spring 200 mounted between the rim 196 of the tubular valve element 194 and a cap 236 which is threaded into the cavity 190. A valve seat 238 is also threaded into the cavity 190 adjacent to an enlarged portion 192 of the master cylinder 130. Passageway 44 communicates with the enlarged portion of the master cylinder 130 while passageway 152 communicates with the cavity 190 in the region between the bottom of the cap 236 and the top of the valve seat 238.

It will be seen that compression spring 200 normally biases the tubular valve element 194 against the valve seat 238 so that piston 202 can pump hydraulic fluid through the hole 198, the cavity 190 and passageway 152. When the piston 202 lifts the tubular valve element 194 away from the valve seat 238, reverse flow of hydraulic fluid from passageway 152 through cavity 190 to passageway 44 occurs. Timing of the opening of the tubular valve element 194 may be controlled by adjusting the piston 202 relative to the connecting rod 204.

Figure 12A:
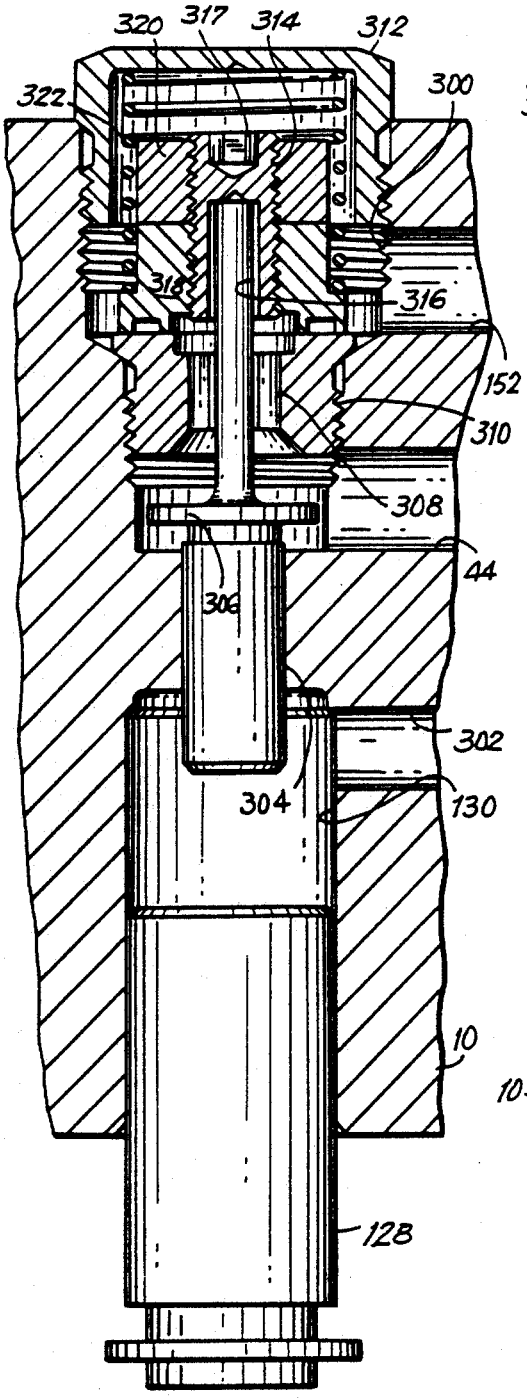
FIG. 12A is a cross-sectional view of a modified form of the trigger check valve shown in FIG. 11A in its unactuated position.
Figure 12B:
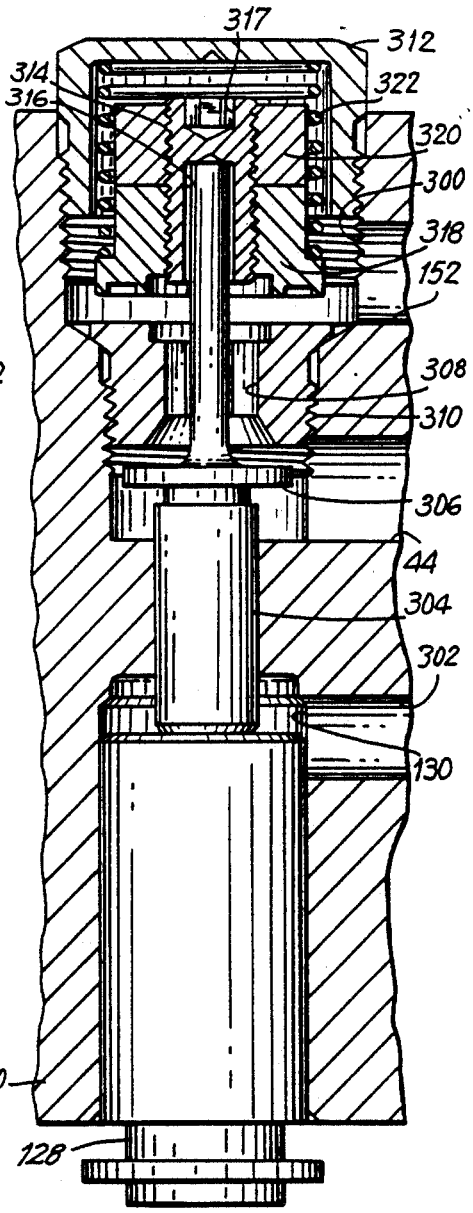
FIG. 12B is a cross-sectional view of the trigger check valve of FIG. 12A in its actuated position.

FIGS. 12A and 12B illustrate a modified form of the trigger check valve shown schematically in FIG. 10; FIG. 12A shows the mechanism at the beginning of the stroke of the master piston 128 while FIG. 12B shows the mechanism at the end of the stroke of the master piston 128. A bore 300 is formed in the housing 10 concentric with the master cylinder 130 and communicates with passageways 152 and 44 which lead, respectively, to the drive cylinder 144 or **144*a* and the slave cylinder 42. Passageway 302 communicates between master cylinder 130 and, preferably, through a check valve (not shown), to passageway 152**.

An actuating pin 304 is closely fitted into the housing 10 coaxially with the master cylinder 130 and extends into the master cylinder 130. Motion of the actuating pin 304 in the direction of the master piston 128 is limited by a collar 306 formed on the actuating pin 304. The upper end of the actuating pin 304 extends through an opening 308 in a trigger valve seat 310 which is threaded into the bore 300 between passageways 152 and 44. A cap 312 seals the bore 300.

The trigger valve assembly comprises an adjusting screw 314 having an axial bore 316 which accommodates the upper end of the actuating pin 304 and a polygonal socket or slot 317 to accommodate an adjusting tool. A trigger valve 318 and a lock nut 320 are threaded onto the adjusting screw 314 and a compression spring 322 seated in the cap 312 biases the trigger valve 318 toward the trigger valve seat 310. It will be understood that upward motion of the master piston 128 drives the actuating pin 304 upwardly and lifts the trigger valve 318 from the trigger valve seat 310 thereby permitting high pressure fluid to flow from passageway 152 through the opening 308 to passageway 44. The precise time at which trigger valve 318 opens depends upon the setting of the adjusting screw 314 which alters the distance between the face of the trigger valve 318 and the lower end of the actuating pin 304. This setting can readily be adjusted simply by removing the cap 312 and the trigger valve assembly.

Because passageways 302 and 152 are interconnected, the pressures on both sides of the trigger valve 318 are essentially equal just before the valve 318 opens. The force required to open the valve 318 is substantially reduced by designing the effective area of the valve 318 to be only slightly larger than the area of the actuating pin 304 where it enters the master cylinder 130.

Figure 13A:
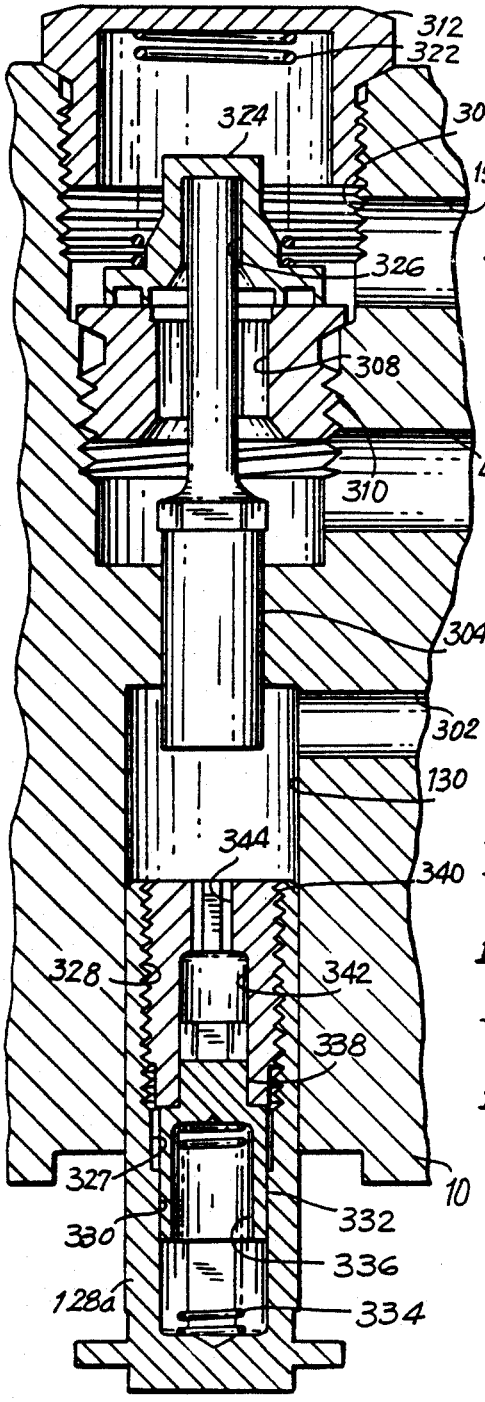
FIG. 13A is a cross-sectional view of a further modified form of the trigger check valve shown in FIG. 11A in its unactuated position.
Figure 13B:
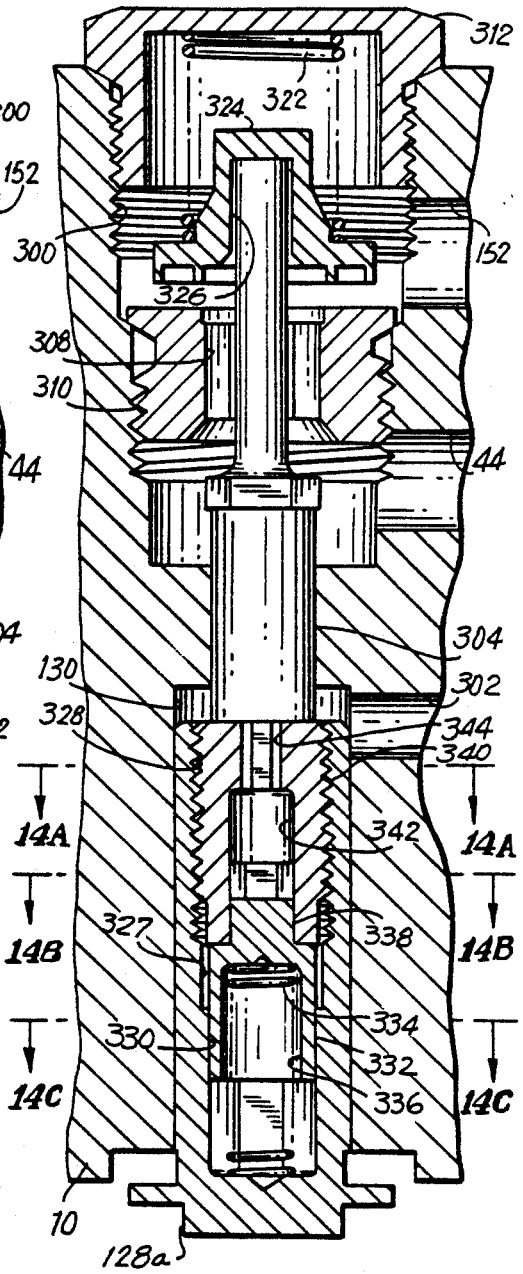
FIG. 13B is a cross-sectional view of the trigger check valve of FIG. 13A in its actuated position.
Figure 14A:
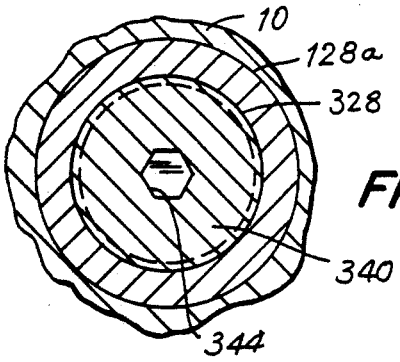
FIG. 14A is a fragmentary cross-section of the trigger check valve taken along lines 14A—14A of FIG. 13B showing the adjusting screw.
Figure 14B:
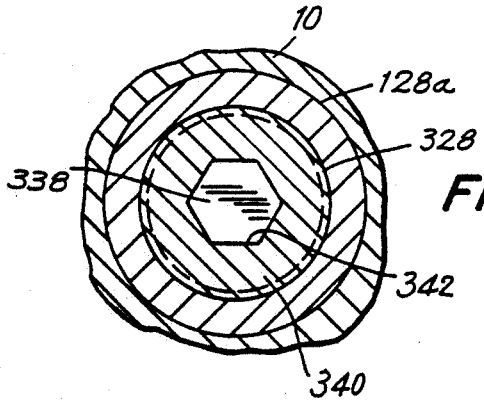
FIG. 14B is a fragmentary cross-section of the trigger check valve taken along lines 14B—14B of FIG. 13B showing one end of the locking means for the adjusting screw.
Figure 14C:
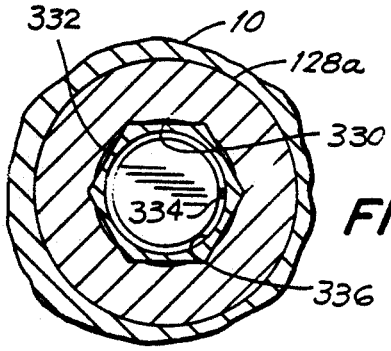
FIG. 14C is a fragmentary cross-section of the trigger check valve taken along lines 14C—14C of FIG. 13B showing the body of the locking means for the adjusting screw.

A variation in the trigger valve of FIGS. 12A and 12B is shown in FIGS. 13A and 13B where parts common to both figures bear the same designators. Again, FIG. 13A shows the mechanism at the beginning of the stroke of the master piston **128*a* while FIG. 13B shows the mechanism at the end of the stroke of the master piston 128*a*. The trigger valve 324 is biased toward the valve seat 310 by compression spring 322 and contains a bore 326 which receives the upper end of the actuating pin 304. As in the case of the mechanism shown in FIGS. 12A and 12B, upward motion of the actuating pin 304 lifts the trigger valve 324 away from the valve seat 310 thereby permitting high pressure fluid to flow from passageway 152 through opening 308 to passageway 44. Adjustment, however, is accomplished in a somewhat different manner. As shown in FIGS. 13A and 13B, the master piston 128*a* is provided with a bore 327 which comprises a threaded portion 328 and a polygonal portion 330. The polygonal portion is preferably hexagonal in shape and is adapted to receive a similarly shaped polygonal locking member 332. The locking member 332 is biased away from the blind end of the bore 327 by a compression spring 334 one end of which is seated in the blind end of the bore 327 while the other end is seated in a bore 336 formed in the locking member 332. The upper end of the locking member 332 is a reduced polygonal section 338. The polygonal shape of the master piston bore 330 and the locking member 332 are shown more clearly in the fragmentary cross-section FIG. 14C while the reduced polygonal section 338 of the locking member 332 appears in fragmentary cross-section FIG. 14B. An adjusting screw 340 is threaded into the threaded portion 328 of the bore 327. The adjusting screw 340 contains a polygonal bore 342 sized to mate with the reduced polygonal section 338 of the locking member 332 and a further reduced polygonal bore 344, best shown in FIG. 14A**.

It will be appreciated that when the locking member 332 has its polygonal surfaces respectively in mating relationship with the polygonal bore 330 of the master piston 128*a* and the bore 342 of the adjusting screw 340, the adjusting screw will be locked into position. However, when a polygonal tool such as a hex or Allen wrench is inserted through the polygonal bore 344, the locking member 332 may be displaced axially against the bias of compression spring 334 and the adjusting screw 340 rotated so as to change the effective length of the master piston 128*a*. This will, in turn, control the point at which the trigger valve 324 is opened. Upon removal of the polygonal tool, the locking member 332 will move back into locking engagement with the adjusting screw 340. Access to the adjusting screw 340 is attained by removing the cap 312 and lifting out the trigger valve 324 and actuating pin 304.

As with the construction illustrated in FIGS. 12A and 12B, the force required to open the trigger valve 324 is minimized by designing the effective area of the trigger valve 324 to be only slightly larger than the area of the actuating pin 304 where it enters the master cylinder 130.

Figure 15:
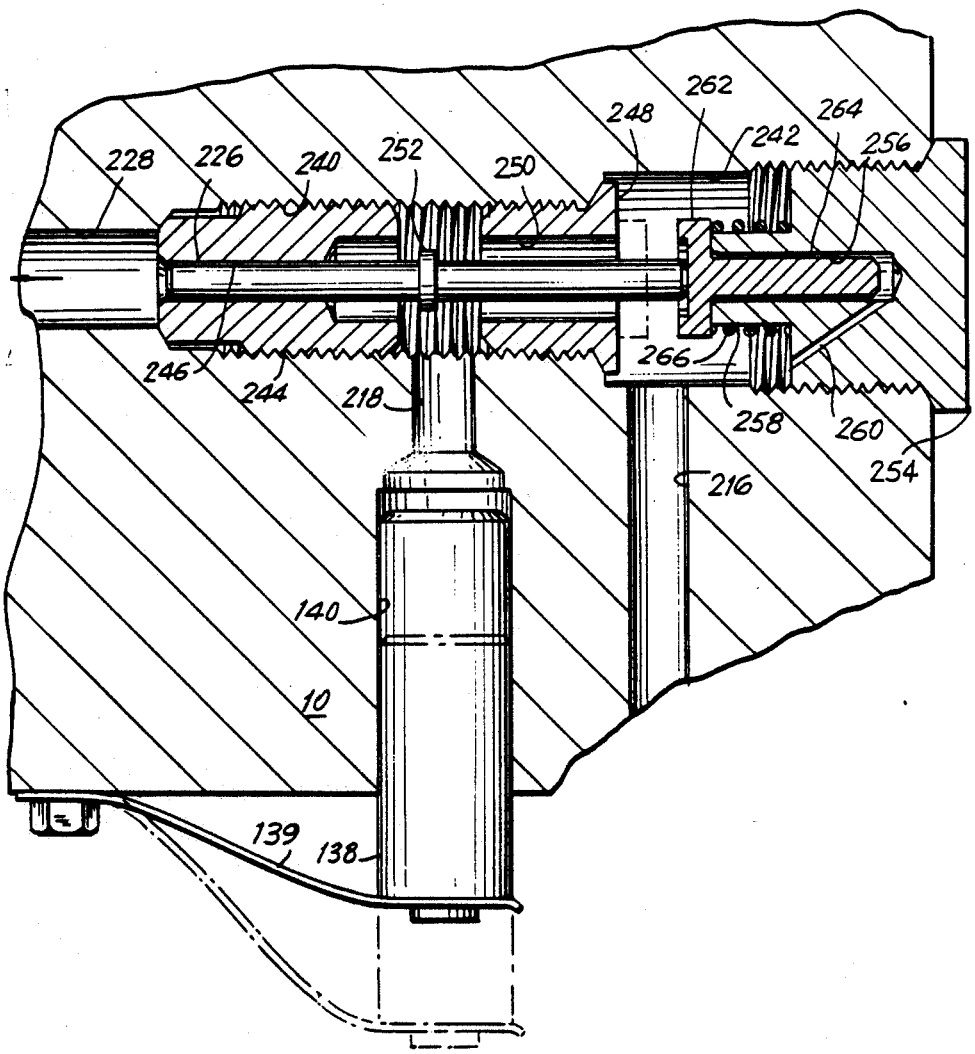
FIG. 15 is a cross-sectional view showing, in more detail, the modified control check valve indicated in FIG. 10.

FIG. 15 shows, in more detail, the preferred check valve shown schematically in FIG. 10 which is associated with the intake master piston 138.

Passageway 228 which leads to the plenum 142*a* contains an enlarged threaded bore 240 which communicates with passageway 218, master cylinder 140 and master piston 138. A further enlarged threaded bore 242 communicates axially with bore 240 and radially with passageway 216 which, through passageway 152 (FIG. 10), communicates with the driving cylinder 144*a* and the trigger check valve. A bushing 244 having an axial bore 246 is threaded into the bore 240. A lapped fit is provided between the guide pin 226 and the bore 246. A valve seat 248 having an axial bore 250 is threaded into the bore 240. Preferably, a collar 252 is formed on the guide pin 226 to limit its axial travel in a direction toward the plenum 142*a*. A valve retaining cap 254 having an axial blind bore 256 and an axial boss 258 is threaded into the further enlarged bore 242. A relief passage 260 communicates between the bottom of the blind bore 256 and an inner surface of the valve retaining cap 254.

A check valve 262 having a support pin 264 is mounted for reciprocating movement in the bore 256 of the retaining cap 254. A light compression spring 266 biases the valve 262 toward the valve seat 248 while plenum pressure in passageway 228 urges the guide pin 226 in a direction to move the check valve 262 away from the valve seat 248. Upward motion of the intake master piston 138 also tends to move the check valve 262 away from the valve seat 248.

Whenever the intake master piston 138 is driven upwardly (as shown in FIG. 15) and the pressure delivered by the master piston exceeds the plenum pressure, hydraulic fluid passes through the bore 250 of valve seat 248, displaces the check valve 262 and flows through passageway 216 towards the driving cylinder 144*a* (FIG. 10). Under these circumstances, check valve 262 functions as an ordinary check valve.

As master piston 138 attains its full stroke and begins its return stroke, the pressure in bore 250 and passageway 218 drops and the check valve 262 is held against its seat 248 against the bias of the plenum pressure acting on the end of guide pin 226. It will be noted that the area of the check valve 262 upon which the pressure from the driving cylinder 144*a* acts is larger than the cross-sectional area of the guide pin 226 which is exposed to the plenum pressure. Thus, the force tending to close the check valve 262 will be larger than the force from the guide pin 226 tending to open the check valve. If, for example, the ratio of the cross-sectional areas of the check valve 262 and guide pin 226 is 7 and the plenum pressure is 3,500 psi, the check valve 262 will open whenever the pressure in passageway 216 and bore 242 falls below 500 psi. For this calculation, the force due to compression spring 266 has been neglected since it is relatively small. It will be understood that when the check valve 262 is opened, hydraulic fluid may flow back into master cylinder 140 to prepare it for the next cycle of operation.

Figure 16:
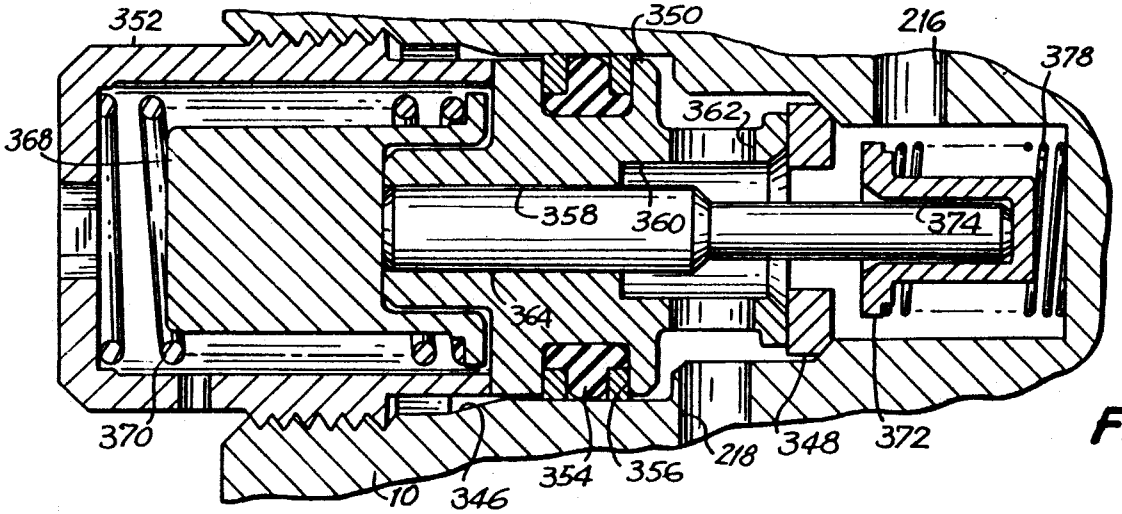
FIG. 16 is a cross-sectional view of a modified form of the control check valve shown in FIG. 15.

A modified form of the check valve of FIG. 15 is shown in FIG. 16 wherein, instead of the plenum pressure, a compression spring is used to bias the check valve to an open position. Referring to FIG. 16, a blind bore 346 is formed in the housing 10 which bore communicates with passageway 218 leading to the intake master cylinder 140 (FIG. 10) and passageway 216 leading to the driving cylinder 144 or 144*a* via passageway 152 (FIG. 10). A valve seat 348 is positioned in the bore 346 by a bushing 350 which, in turn, is positioned by a cap 352 threaded into the bore 346. Preferably, the bushing 350 is sealed with respect to the bore 346 by a resilient gasket 354 set in a circumferential groove 356 formed on the bushing 350. An axial bore 358 having an enlarged portion 360 is formed in the bushing 350. A transverse bore 362 communicates with the enlarged portion 360 of the axial bore 358. An actuating pin 364 is closely fitted into the bore 358. A drive collar 368 is biased against one end of the bushing 350 by a compression spring 370 seated against the inside end of the cap 352. The drive collar 368, in turn, biases the actuating pin 364 in an axial direction. The drive collar 368 limits the axial motion of the actuating pin 364 in the direction of the cap 352.

A check valve 372 is provided with an axial blind bore 374 which receives one end of the actuating pin 364. The check valve carries a compression spring 378 which lightly biases the check valve 372 toward the valve seat 348.

It will be seen that whenever the pressure in the driving cylinder 144 or 144*a* (FIG. 10) acting through passageway 216 but resulting from the pressure initiated by the intake master piston 138 acting through passageway 218 produces a force on the actuating pin 364 which exceeds the force due to the spring 370, the check valve 372 will seat on the valve seat 348 and function as a check valve. However, when the opening force due to the spring 370 exceeds the closing force due to the pressure in passageway 216, the valve 372 will reopen. Thus, the valve of FIG. 16 provides the same function as the valve of FIG. 15.

Figure 17:
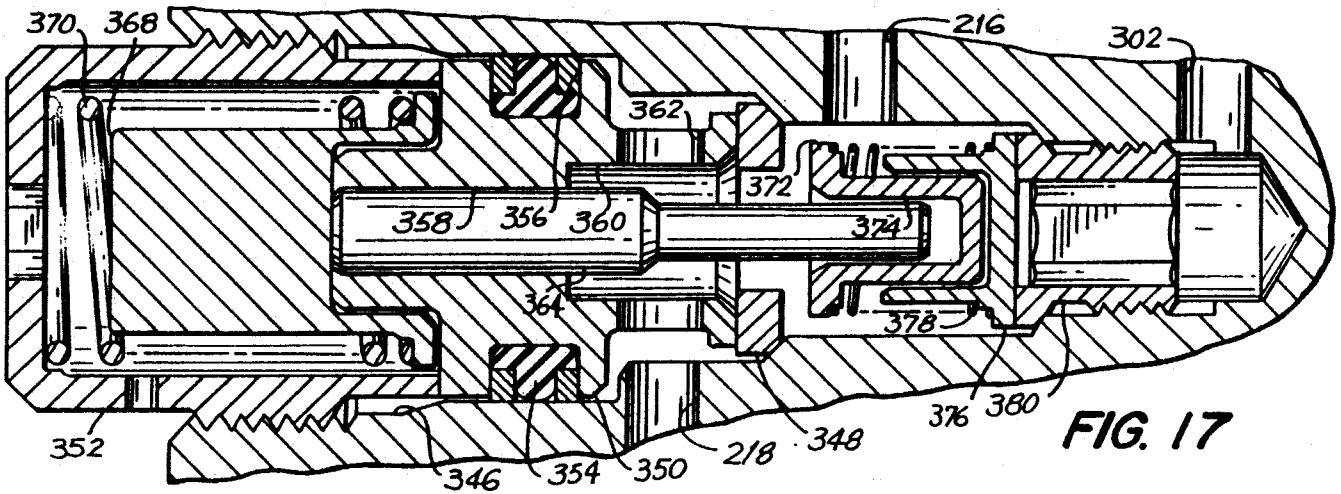
FIG. 17 is a cross-sectional view of the control check valve shown in FIG. 16 and incorporating, in addition, a check valve.

It was noted with respect to FIGS. 12 and 13 that the passageway 302 preferably communicated with passageway 152 through a check valve. It also appears from FIG. 10 that passageway 152 communicates with passageway 216. For this reason it is convenient to combine the check valve desired for the operation of the trigger valves shown in FIGS. 12 and 13 with the control check valve of FIG. 16. Such a combination is shown in FIG. 17 wherein a check valve 376 seats on a check valve seat 380 which is threaded into the blind bore 346. A passageway 302 leading to the exhaust master cylinder 130 (FIGS. 12A and 12B) communicates with the blind bore 346 on the opposite side of the check valve seat 380 from the check valve 376. It will be seen that whenever the master piston 128 (FIGS. 12A and 12B) or 128*a* (FIGS. 13A and 13B) is driven upwardly hydraulic fluid is pumped through passageway 302 past the check valve 376 to passageway 216 thereby pressurizing the plenum 142 or 142*a*.

Figure 18:
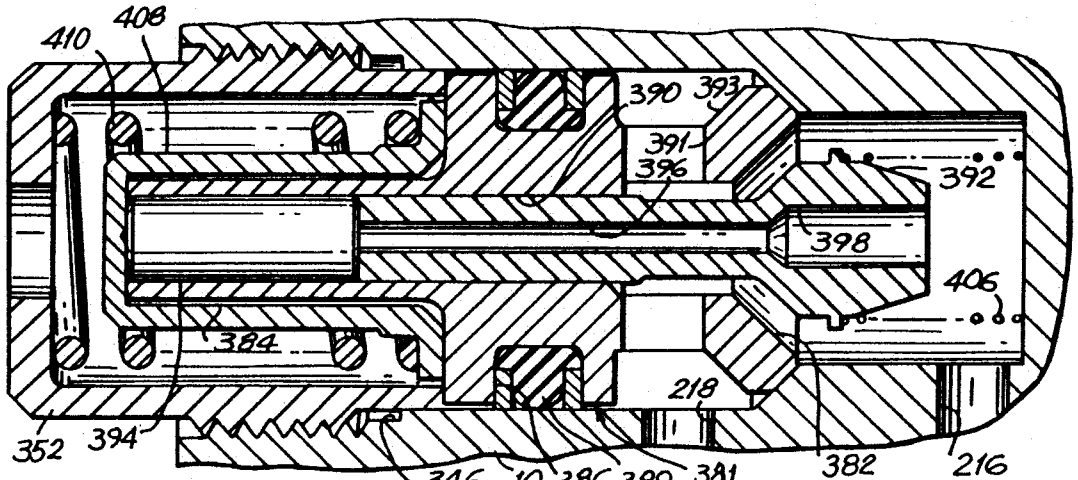
FIG. 18 is a cross-sectional view of a modified form of the control check valve shown in FIG. 16.

A modification of the control check valve of FIG. 16 is shown in FIG. 18 wherein similar parts are identified by the same designations, the description of which will not be repeated. A bushing 381 is positioned within a blind bore 346 and held in place by a cap 352 threaded into the blind bore 346. The bushing comprises, at one end, a control check valve seat 382 and, at the other end, a piston chamber 384. A circumferential channel 386 is formed at the mid region of the bushing 381 to receive a gasket 388 and thereby seal the bushing 381 with respect to the blind bore 346. An axial bore 390 is formed through the bushing 381 to receive a control check valve 392 and a piston 394. The piston 394 and the control check valve 392 are closely fitted into the bore 390. A transverse bore 391 communicates between the axial bore 390 and a circumferential channel 393 formed on the outer surface of the bushing 381. Channel 393 communicates with passageway 218. The control check valve 392 includes an axial bore 396 having an enlarged section 398 adjacent one end of the control check valve. Compression spring 406 biases the check valve 392 toward its seat 382.

A drive collar 408 surrounds the piston chamber 384 and seats against the central region of the bushing 381. A compression spring 410 having one end seated against the inside surface of the cap 352 biases the drive collar 408 toward the bushing 381.

The operation of the control check valve of FIG. 18 is as follows: When the engine retarder is in the "off" position, there will be no hydraulic pressure in passageway 218 leading to the intake master cylinder 140 (FIG. 10) or in passageway 216 leading to the driving cylinder 144*a* (FIG. 10). Since compression spring 410 exerts a much higher force than spring 406, the control check valve 392 will be maintained in the open position as illustrated in FIG. 18. When the retarder is turned on, hydraulic fluid at low pressure will flow from passageway 216 through the control check valve 392 and into passageway 218 so as to fill the system, including the intake and exhaust master cylinders. However, at the relatively low fill pressure the control check valve 392 will remain open. As the intake master piston 138 is driven by the intake pushtube, the pressure in passageway 218 builds up until, at a predetermined pressure the bias of spring 410 is overcome and the control check valve 392 is closed. The hydraulic pressure acting through bore 396 of the control check valve 392 drives the piston 394 and the drive collar 408 to the inside end of the cap 352 so as to be entirely clear of the control check valve. So long as the pressure in the system is above the predetermined pressure, the control check valve 392 functions as a check valve to permit flow of hydraulic fluid from passageway 218 to passageway 216. Thus, after the intake master piston 138 reaches its maximum extension and begins its return, the pressure will be maintained in passageway 216. Thereafter, the exhaust master piston 128 is driven so as to further increase the pressure in passageway 216. When the trigger valve 194 is actuated by the motion of the master piston 128, the pressure in passageway 216 will drop to a low level so that the compression spring 410 will drive the piston 394 and the control check valve 392 to the open position. It will be appreciated that whenever the system is at a pressure above the pressure at which the drive collar 408 and piston 394 are separated from the control check valve 392 the valve 392 will function as a check valve.

Figure 19:
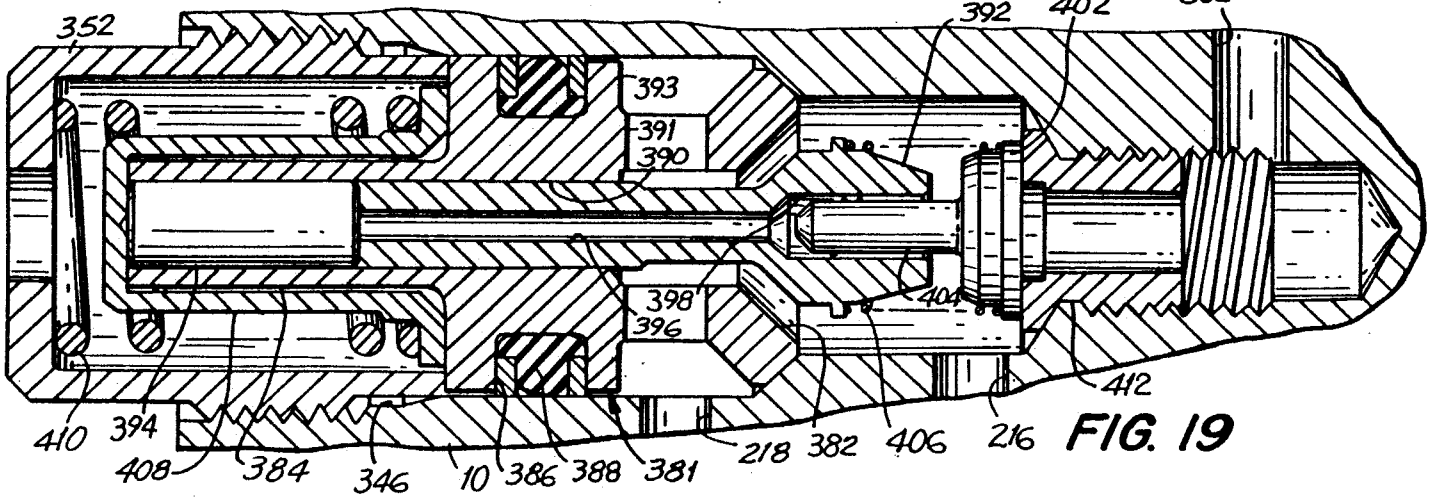
FIG. 19 is a cross-sectional view of the modified control check valve shown in FIG. 18 and incorporating, in addition, a check valve.

FIG. 19 illustrates the control check valve of FIG. 18 combined with an additional check valve, an arrangement particularly suited for use with the trigger valves illustrated in FIGS. 12 and 13. The additional check valve 402 is provided by locating a valve seat 412 in an extension of the blind bore 346 and directing passageway 302 (FIGS. 12 and 13) so as to intersect bore 346 on the side of the seat 412 opposite check valve 402.

It will be appreciated that the construction shown in FIGS. 18 and 19 involves a pressure balanced system wherein, when acting as a check valve, the control check valve 392 may be opened or closed as a result of a small pressure differential. This minimizes the load on the engine intake pushtubes.

While the description has proceeded to the present principally with respect to the improvement of an exhaust pushtube-actuated retarder, it will be appreciated that the principles herein outlined are equally applicable to an injector pushtube-actuated retarder. However, when applied to an injector pushtube-actuated retarder the improvement in performance will be less dramatic because the characteristics of the injector cam are more favorable for retarding purposes than those of the exhaust cam. In U.S. Pat. No. 4,572,114 and U.S. Pat. No. 4,592,319 assigned to the assignee of the present application, retarding processes and apparatus are disclosed for producing two compression release events per cylinder per engine cycle, i.e., one compression release event per cylinder per crankshaft revolution. The invention disclosed herein may also be used in conjunction with the inventions disclosed in the above-cited patents. Considering a six cylinder engine having the usual firing order 1-5-3-6-2-4, a retarding system providing two compression release events per engine cycle may be arranged as set forth in Table II below:

TABLE II

| Retarded Cylinder | First Compression Release | Second Compression Release | Pump |
|---|---|---|---|
| 1 | Injector #1 | Exhaust #5 | Intake #1 |
| 5 | Injector #5 | Exhaust #3 | Intake #5 |
| 3 | Injector #3 | Exhaust #6 | Intake #3 |
| 6 | Injector #6 | Exhaust #2 | Intake #6 |
| 2 | Injector #2 | Exhaust #4 | Intake #2 |
| 4 | Injector #4 | Exhaust #1 | Intake #4 |

For engines having no fuel injector cam or pushtube an arrangement as set forth below in Tables III or IV is feasible:

TABLE III

| Retarded Cylinder | First Compression Release | Second Compression Release |
|---|---|---|
| 1 | Exhaust #2 | Intake #4 |
| 5 | Exhaust #4 | Intake #1 |
| 3 | Exhaust #1 | Intake #5 |
| 6 | Exhaust #5 | Intake #3 |
| 2 | Exhaust #3 | Intake #6 |
| 4 | Exhaust #6 | Intake #2 |

TABLE IV

| Retarded Cylinder | First Compression Release | Second Compression Release |
|---|---|---|
| 1 | Intake #3 | Exhaust #5 |
| 5 | Intake #6 | Exhaust #3 |
| 3 | Intake #2 | Exhaust #6 |
| 6 | Intake #4 | Exhaust #2 |
| 2 | Intake #1 | Exhaust #4 |
| 4 | Intake #5 | Exhaust #1 |

It will be noted that in Tables III and IV no master cylinder and piston is provided to perform the pumping function of master cylinder 140 and master piston 138 in FIGS. 4–9. In order to meet the pumping requirements of the system the master cylinders and pistons associated with the exhaust and/or intake pushtubes may be increased in diameter. This, of course, will cause an increase in the pushtube loading and care must be taken not to exceed the design load limits for these components.

For purposes of clarity and simplicity, the above description has been based on a six cylinder engine having a firing order 1-5-3-6-2-4. Other firing orders may be encountered as well as engines having differing numbers of cylinders. The present invention may be applied to such engines by identifying a pushtube or rocker arm the motion of which occurs during the compression stroke of the cylinder to be retarded; identifying a second pushtube or rocker arm the motion of which occurs during the exhaust stroke of the cylinder to be retarded (if two compression release events per engine cycle are desired); and/or identifying a third pushtube or rocker arm the motion of which can be utilized to provide pumping (if a separate pumping action is desired). Properly sized master pistons may then be provided for each of the identified pushtubes and the system interconnected as shown, for example, in FIGS. 4–9.

The terms and expressions which have been employed are used as terms of description and not of limitation and there is no intention in the use of such terms and expressions of excluding any equivalents of the features shown and described or portions thereof but it is recognized that various modifications are possible within the scope of the invention claimed.

What is claimed is:

1. A control check valve for use in an hydraulic circuit comprising a body having a first bore formed therein, first and second passageways communicating with said first bore, a bushing seated in said first bore, said bushing having a second bore formed therethrough, a valve actuating pin closely fitted for axial movement in said second bore, a first valve seat seated in said first bore between said first and second passageways and having a third bore formed therethrough, said third bore having a larger diameter than the diameter of said valve actuating pin, a bushing retaining cap threaded into said first bore, a drive collar communicating with said bushing, a compression spring seated between said bushing retaining cap and said drive collar to bias said drive collar and said valve- actuating pin in an axial direction, a first valve mounted for axial movement by said valve actuating pin and spring means adapted to bias said first valve toward said valve seat.

2. A control check valve a described in claim 1 wherein said first valve sea and said bushing comprise a unitary structure.

3. A control check valve as described in claim 1 wherein said first passageway communicates with said third bore through said first bore and said bushing.

4. A control check valve as described in any of claims 1, 2, or 3 and comprising in addition a second valve seat positioned in said first bore, a third passageway communicating with said first bore, said second valve seat located axially in said first bore between said second and third passageways, a check valve biased by said spring means to seat against said second valve seat.

5. A control check valve as described in claim 1 comprising, in addition, a piston positioned for axial movement with respect to said third bore in said bushing.

6. A control check valve as described in claim 1 wherein said first valve and said valve actuating pin comprise a unitary structure.

7. A control check valve as described in claim 2 wherein said first valve and said valve actuating pin comprise a unitary structure.

8. A control check valve as described in claim 6 wherein a fourth bore is formed axially through said unitary structure comprising said valve actuating pin and said first valve.

9. A control check valve as described in claim 8 and comprising, in addition, a piston positioned for axial movement with respect to said second bore in said bushing.

10. A control check valve as described in any of claims 5, 6, 7, 8, or 9 and comprising in addition a second valve seat positioned in said first bore and a third passageway communicating with said first bore and said second valve seat located axially in said first bore between said second and third passageways, and a check valve biased by said spring means to seat against said second valve seat.

* * * * *